US005258259A

United States Patent [19]

Inoue et al.

[11] Patent Number: 5,258,259

[45] Date of Patent: Nov. 2, 1993

[54] IMAGE FORMING METHOD WITH REDOX DEVELOPMENT INHIBITOR

[75] Inventors: Nobuaki Inoue; Hisashi Okamura, both of Kanagawa, Japan

[73] Assignee: Fuji Photo Film Co., Ltd., Kanagawa, Japan

[21] Appl. No.: 810,558

[22] Filed: Dec. 20, 1991

Related U.S. Application Data

[63] Continuation of Ser. No. 582,314, Sep. 14, 1990, abandoned.

[30] Foreign Application Priority Data

Sep. 14, 1989 [JP] Japan ..... 1-239276

[51] Int. Cl.[5] ..... G03C 5/26; G03C 7/06

[52] U.S. Cl. ..... 430/264; 430/223; 430/396; 430/512; 430/606; 430/957

[58] Field of Search ..... 430/264, 223, 957, 606, 430/598, 512, 396

[56] References Cited

U.S. PATENT DOCUMENTS

| | | | |
|---|---|---|---|
| 4,619,884 | 10/1986 | Singer | 430/598 |
| 4,684,604 | 8/1987 | Harder | 430/598 |
| 4,762,769 | 8/1988 | Takahashi et al. | 430/264 |
| 4,770,990 | 9/1988 | Nakamura et al. | 430/957 |
| 4,847,180 | 7/1989 | Miyata et al. | 430/264 |
| 4,939,067 | 7/1990 | Takagi et al. | 430/598 |
| 4,980,276 | 12/1990 | Arai et al. | 430/598 |
| 5,085,970 | 2/1992 | Kamecka et al. | 430/264 |
| 5,085,971 | 2/1992 | Katoh et al. | 430/264 |

*Primary Examiner*—Richard L. Schilling

*Attorney, Agent, or Firm*—Sughrue, Mion, Zinn, Macpeak & Seas

[57] ABSTRACT

A method of forming an image comprising the steps of (a) imagewise exposing a silver halide photographic material to light substantially having no wavelengths of less than 370 nm, the silver halide photographic material comprising: (i) a support, (ii) at least one light-sensitive silver halide emulsion layer formed on the support, (iii) at least one other hydrophilic colloid layer, and (iv) a redox compound that releases a development inhibitor when oxidized in at least one of the at least one light-sensitive layer or the at least one hydrophilic colloid layer; and (b) processing the exposed silver halide material from step (a) to produce a $\tau$ value of at least 10.0. The redox compound is a compound represented by formula (I):

$$R-\underset{A_1}{N}-\underset{A_2}{N}-V\text{-}(\text{Time})_t\text{-}PUG \qquad (I)$$

wherein $A_1$ and $A_2$ are preferably both a hydrogen atom; Time represents a divalent linkage group; t represents 0 or 1; PUG represents a development inhibitor; V can represent a carbonyl group; and R represents an aliphatic group, an aromatic group, or a heterocyclic group.

12 Claims, 1 Drawing Sheet

FIG. 1(a)
FIG. 1(b)
FIG. 1(c)
FIG. 1(d)
FIG. 1(e)
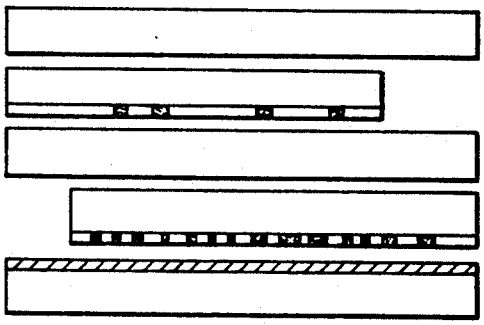
FIG. 2
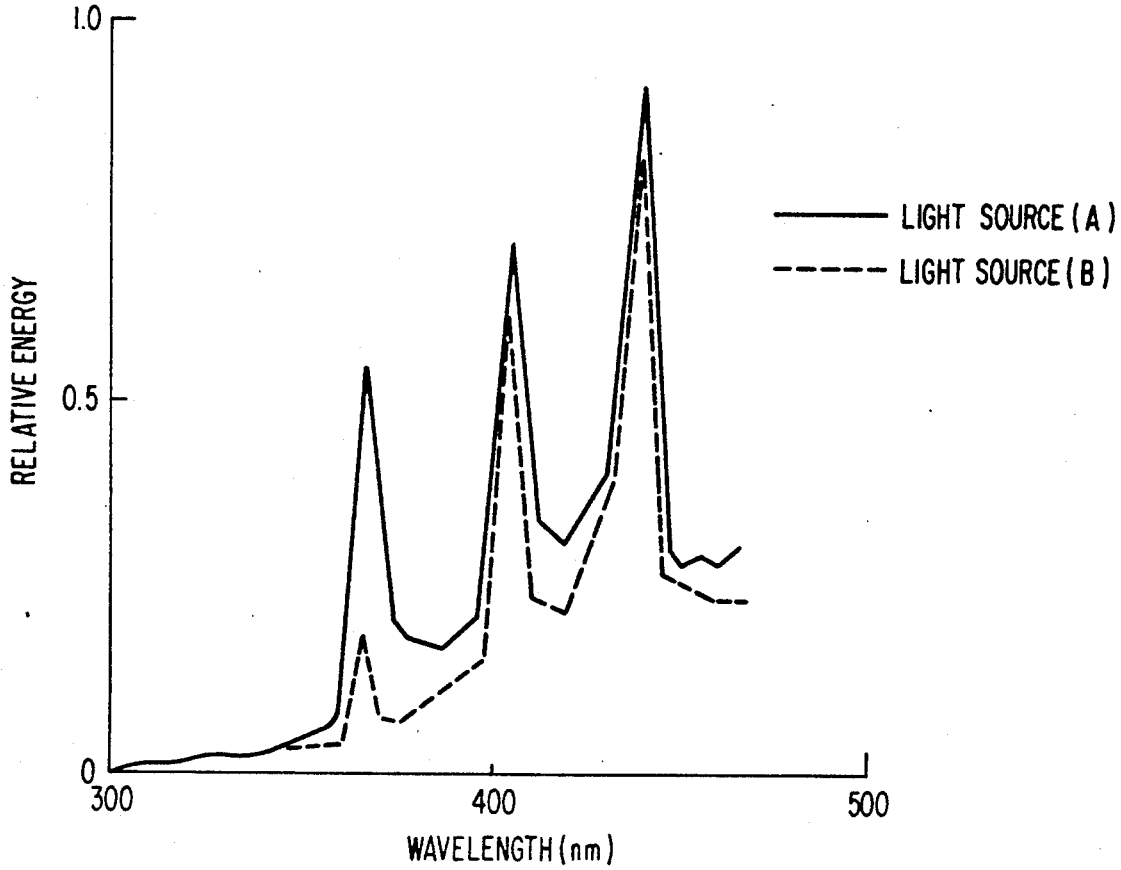

IMAGE FORMING METHOD WITH REDOX DEVELOPMENT INHIBITOR

This is a continuation of application No. 07/582,314 filed Sep. 14, 1990 now abandoned.

FIELD OF THE INVENTION

The present invention relates to an image forming method using photographic light-sensitive material that can be handled under a safelight and used in a photomechanical printing process.

BACKGROUND OF THE INVENTION

In the field of print duplication, improvement in the working efficiency of photomechanical processing has long been desired to deal with the present variety of diversified and complicated print forms. In particular, plate assembly and dot-to-dot processes have been attempted in brighter "light-rooms" under safelights to improve the working efficiency of photomechanical processing.

Photographic light-sensitive materials for use under safelights in light-rooms (hereinafter, safelight-sensitive material) used for plate assembly and contact work are generally used for negative/positive image conversion or positive/positive image conversion.

It is desired that by contact exposing light-sensitive material that processed film having original quality letters and/or dot images can be produced. In order to do this, the light-sensitive material must have the following characteristics: (1) the negative/positive conversion or positive/positive conversion of the dot images, line images, and letter images on the original can be carried out in accordance with the dot area, line width, and the letter width, respectively; and (2) the tone of the dot images and the line width of the letter images can be controlled.

Photographic light-sensitive materials that meet these characteristics have been available.

However, in a highly advanced image conversion work known such as reproducing white letter on solid background by contact duplication using known safelight-sensitive material yields inferior images compared to conventional contact work in a dark-room using conventional photographic light-sensitive material.

FIG. 1 shows the formation of images of white letters on a solid background by contact duplication. A transparent or translucent film base (a) (usually, a polyethylene terephthalate film having thickness of about 100 μm); line original (b) having letters or line images formed on it; a transparent or translucent film base (c) (usually, a polyethylene terephthalate film having a thickness of about 100 μm); and a dot original (d) having dot images formed on it are layered and brought into contact with the silver halide emulsion layer of a photographic light-sensitive material (e) prior to exposure.

After exposure, the photographic light-sensitive material is processed to form the transparent parts of the line images formed in the dot image.

When forming images of white letters on a solid background, the negative/positive image conversion is ideally carried out in accordance with the dot area and the image line width of the dot original and the line original, respectively. However, as can be seen in FIG. 1, the dot original (d) is exposed when it is in direct contact with the emulsion layer of the photographic light-sensitive material (e), while the line original (b) is exposed through the intervening film base (c) and the dot original (d).

Because of this arrangement, when sufficient exposure for negative/positive image conversion of the dot original is given, the line width of the transparent parts of the line image is narrowed since the line original is exposed with blurring through the intervening film base (c) and the dot original (d). These factors cause a deterioration in the reproduction quality of white letter on a solid background; a phenomenon that is greatly influenced by the photographic performance of the light-sensitive material and the exposure light source.

Techniques for improving image quality by imagewise exposing photographic light-sensitive material containing a hydrazine derivative and having a $\tau$ value of at least 10 in light having no wavelengths less than 370 nm are disclosed in JP-A-62-80640 (the term "JP-A" as used herein refers to a "published unexamined Japanese patent application"), JP-A-62-235938, JP-A-62-235939, JP-A-63-104046, JP-A-63-103235, and JP-A-63-296031.

Silver halide photographic materials containing a redox compound releasing a development inhibitor when oxidized are disclosed in JP-A-61-213847, JP-A-64-72410, JP-A-64-72144 and JP-A-64-72139.

SUMMARY OF THE INVENTION

An object of the present invention is to provide an image forming method capable of forming high quality images of white letters on a solid background by contact exposure using a safelight-sensitive material.

This and other objects of the present invention have been attained by method of forming an image comprising the steps of (a) imagewise exposing a silver halide photographic material to light substantially having no wavelengths of less than 370 nm, said silver halide photographic material comprising: (i) a support, (ii) at least one light-sensitive silver halide emulsion layer formed on said support, (iii) at least one other hydrophilic colloid layer, and (iv) a redox compound that releases a development inhibitor when oxidized in at least one of said at least one light-sensitive layer or said at least one hydrophilic colloid layer; and (b) processing said exposed silver halide material from step (a) to produce a $\tau$ value of at least 10.0.

The $\tau$ value is defined as follows:

$$\gamma = \frac{3.0 - 0.3}{\log(A) - \log(B)}$$

(A): Exposure amount giving a density of 3.0
(B): Exposure amount giving a density of 0.3

BRIEF DESCRIPTION OF THE DRAWINGS

FIG. 1 is a schematic view showing transparent or translucent film bases FIG. 1(*a*) and FIG. 1(*c*), a line original FIG. 1(*b*) (the black parts indicate line images), a dot original FIG. 1(*d*) (the black parts indicate the dots), and a photographic light-sensitive material arranged for forming an image of white letters on a solid background by contact reproduction FIG. 1(*e*).

FIG. 2 is a graph showing the spectral energy distribution of light sources A and B each being used for exposure, wherein the ordinate shows relative energy and the abscissa shows the wavelength in nanometers.

DETAILED DESCRIPTION OF THE INVENTION

The silver halide photographic material for use in the present invention contains a redox compound capable of releasing a development inhibitor when oxidized. Examples of redox compounds are hydroquinones, catechols, naphthohydroquinones, aminophenols, pyrazolidones, hydrazines, hydroxylamines, and reductants. Among these, hydrazines are the preferred redox compound. The compounds represented by formula (I) are particularly preferred as the redox compound:

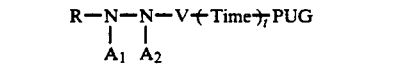

(I)

wherein $A_1$ and $A_2$ both represent a hydrogen atom or one of them represents a hydrogen atom and the other represents an alkylsulfonyl group, an arylsulfonyl group or

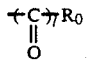

(wherein $R_0$ represents an alkyl group, an alkenyl group, an aryl group, an alkoxy group, or an aryloxy group; and l represents 1 or 2); Time represents a divalent linkage group; t represents 0 or 1; PUG represents a development inhibitor; V represents a carbonyl group,

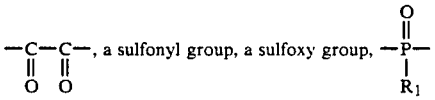

(wherein $R_1$ represents an alkoxy group or an aryloxy group), an iminomethylene group, or a thiocarbonyl group; and R represents an aliphatic group, an aromatic group, or a heterocyclic group.

In formula (I), $A_1$ and $A_2$ both represent a hydrogen atom, or one of them represents a hydrogen atom and the other represents an alkylsulfonyl group preferably having not more than 20 carbon atoms, an arylsulfonyl group (preferably, a phenylsulfonyl group or a substituted phenylsulfonyl group where the sum of the Hammett constants is at least −0.5), or

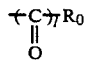

(wherein $R_0$ preferably represents a straight chain, branched, or cyclic alkyl group having not more than 30 carbon atoms, an alkenyl group, an aryl group (preferably a phenyl group or a phenyl group substituted such that the sum of the Hammett constants is at least -0.5), an alkoxy group (e.g., an ethoxy group), or an aryloxy group (preferably, a monocyclic aryloxy group), these groups may be substituted by a substituent illustrated below and the substituent may be further substituted).

Examples of the aforesaid substituent are an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxy group, an aryloxycarbonyl group, an acyl group, an alkoxycarbonyl group, an acyloxy group, a carbonamido group, a sulfonamido group, a nitro group, an alkylthio group, and an arylthio group.

Also, $A_1$ may combine with (Time)t to form a ring. $A_1$ and $A_2$ are most preferably a hydrogen atom.

In formula (I), Time represents a divalent linkage group which may have a timing controlling function.

In formula (I), t represents 0 or 1 and the case where t is 0 means that PUG is directly bonded to V.

The divalent linkage group represented by Time is a group releasing PUG via a single stage or multistage reaction from Time-PUG released from the oxidation product of the redox nucleus.

Examples of the divalent linkage group represented by Time are linkage groups releasing a photographically useful group (PUG) by an intramolecular ring closing reaction of a p-nitrophenoxy derivative (as described in U.S. Pat. No. 4,248,962 (JP-A-54-145135)); linkage groups releasing PUG by an intramolecular ring closing reaction after ring cleavage (as described in U.S. Pat. Nos. 4,310,612 (JP-A-55-53330), and 4,358,252); linkage groups releasing PUG with the formation of an acid anhydride by an intramolecular ring closing reaction of the carboxy group of a succinic acid monoester or an analog thereof (as described in U.S. Pat. Nos. 4,330,617, 4,446,216, 4,483,919, and JP-A-59-121328); linkage groups releasing PUG with the formation of quinomonomethane or a analog thereof by an electron transfer via the conjugated double bond of an aryloxy group or a heterocyclic oxy group (as described in U.S. Pat. Nos. 4,409,323 and 4,421,845, *Research Disclosure*, No. 21228 (December, 1981), U.S. Pat. No. 4,416,977 (JP-A-57-135944), JP-A-58-209736 and JP-A-58-209738); linkage groups releasing PUG from the $\tau$-position of enamine by the electron transfer of a moiety having an enamine structure of a nitrogen-containing heterocyclic ring (as described in U.S. Pat. No. 4,420,554 (JP-A-57-136640), JP-A-57-135945, JP-A-57-188035, JP-A-58-98728, and JP-A-58-209737); linkage groups releasing PUG by an intramolecular ring closing reaction of the oxy group formed by an electron transfer to a carbonyl group conjugated with the nitrogen atom of a nitrogen-containing heterocyclic ring (as described in JP-A-57-56837); linkage groups releasing PUG with the formation of aldehydes (as described in U.S. Pat. No. 4,146,396 (JP-A-52-90932), JP-A-59-93442 and JP-A-59-75475); linkage groups releasing PUG with decarboxylation of a carboxy group (as described in JP-A-51-146828, JP-A-57-179842, and JP-A-59-104641); linkage groups having a structure of -O-COOR$_a$R$_b$-PUG (both $R_a$ and $R_b$ represent a hydrogen atom or a monovalent organic group) and releasing PUG with the formation of aldehydes succeeding decarboxylation; linkage groups releasing PUG with the formation of an isocyanate (as described in JP-A-60-7429); and linkage groups releasing PUG by a coupling reaction with the oxidation product of a color developing agent (as described in U.S. Pat. No. 4,438,193).

Specific examples of the divalent linkage group represented by Time are described in JP-A-61-236549 and JP-A-1-269936 and preferred examples are represented below, wherein (*) represents a site at which (Time)$_t$-

PUG is bonded to V in formula (I) and (*)(*) represents a site at which PUG is bonded.
T-(1)
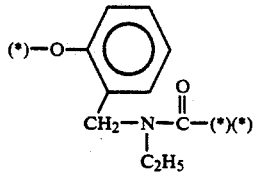
T-(2)
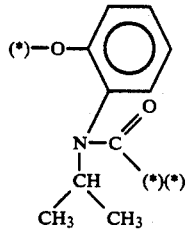
T-(3)
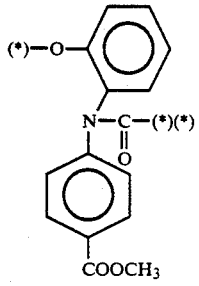
T-(4)
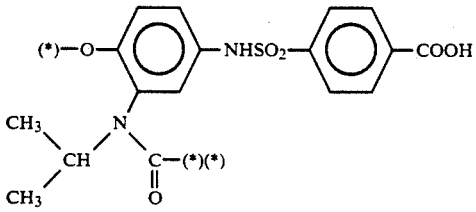
T-(5)
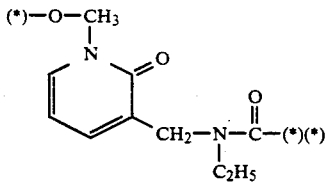
T-(6)
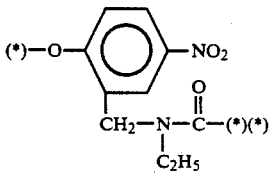
T-(7)
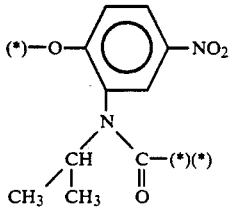
-continued
T-(8)
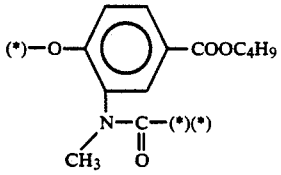
T-(9)
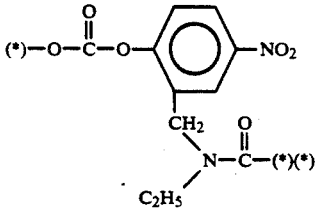
T-(10)
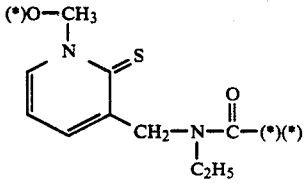
T-(11)
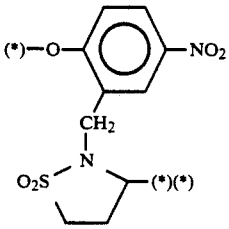
T-(12)
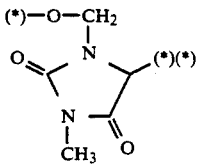
T-(13)
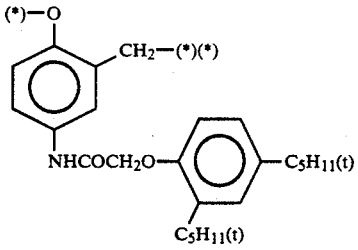
T-(14)
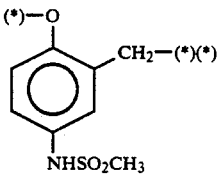
T-(15)
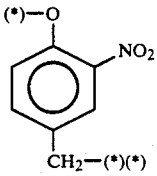

-continued
T-(16)
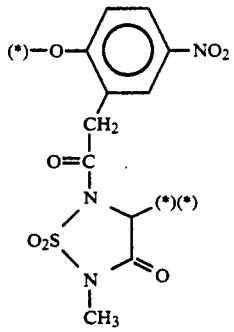
T-(17)
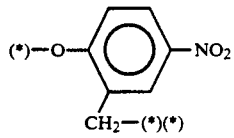
T-(18)
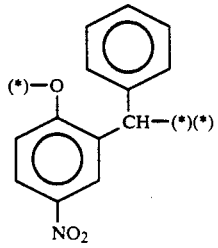
T-(19)
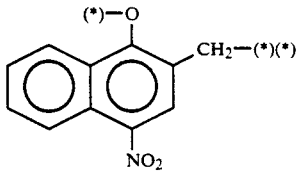
T-(20)
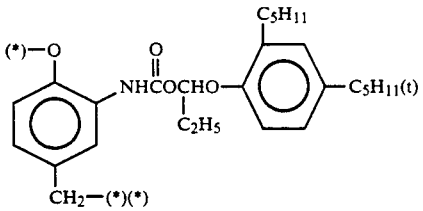
T-(21)
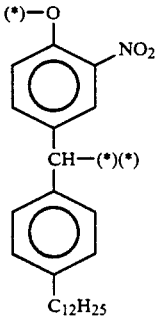
T-(22)
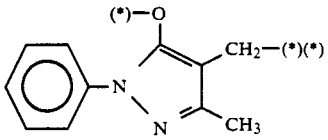
-continued
T-(23)
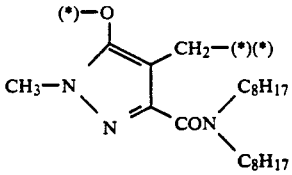
T-(24)
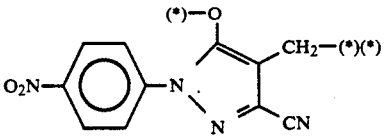
T-(25)
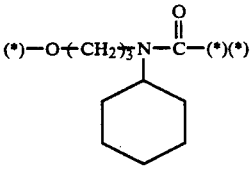
T-(26)
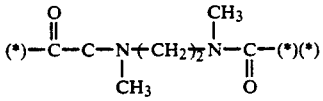
T-(27)
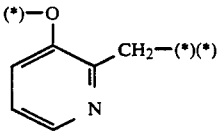
T-(28)
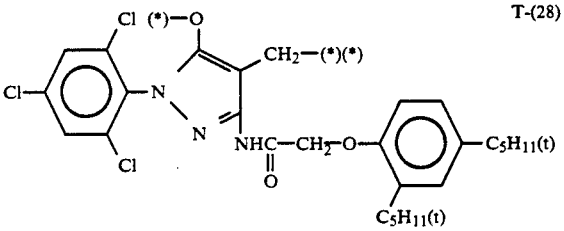
T-(29)
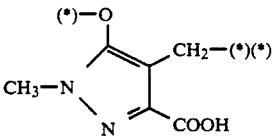
T-(30)
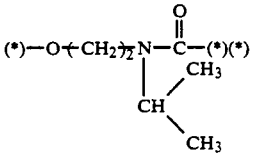
T-(31)
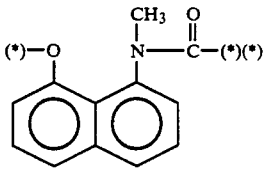
T-(32)
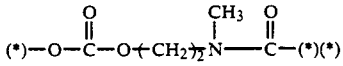
T-(33)
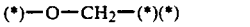

-continued

T-(34)

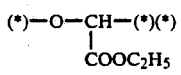

T-(35)

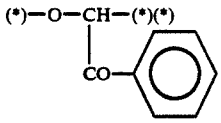

T-(36)

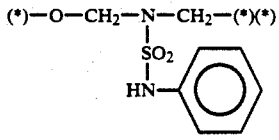

T-(37)

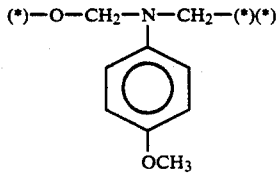

T-(38)

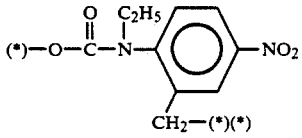

T-(39)

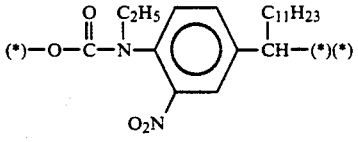

T-(40)

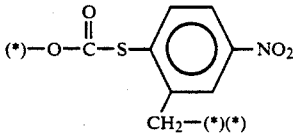

T-(41)

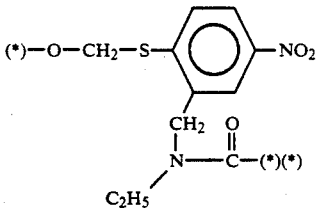

T-(42)

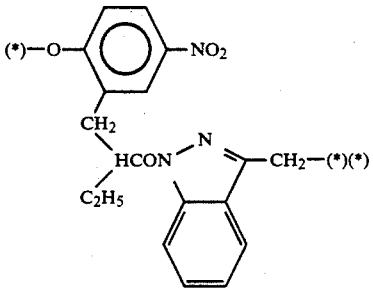

In formula (I), PUG represents a group having a development inhibiting action as -(Time)$_t$-PUG or PUG.

The development inhibitor represented by PUG or -(Time)$_t$PUG is a known development inhibitor having a hetero atom and bonded to

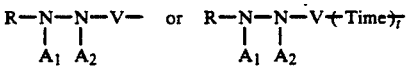

in formula (I) via the hetero atom. These are described in C. E. K. Mees and T. H. James, *The Theory of Photographic Processes,* 3rd Ed., pages 344 to 346, published in 1966 by Macmillan Co.

Specific examples of development inhibitors are mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes, and mercaptoaryls.

The development inhibitor represented by PUG may be substituted by the substituent mentioned below and these substituents may be further substituted. Examples of useful substituents are an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxy group, a sulfoxy group, a phosphono group, a phosphinyl group, and a phosphoric acid amido group.

Preferred substituents are a nitro group, a sulfo group, a carboxy group, a sulfamoyl group, a phosphono group, a phosphinyl group, and a sulfonamido group.

The following are specific examples of compounds of each type of development inhibitor useful in the present invention:

1. Mercaptotetrazole Compounds:

(1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(o-Naphthyl)-5-mercaptotetrazole
(19) 1-(4-Sulfophenyl)-5-mercaptotetrazole

(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole Hydrochloride
(32) 1-(2-Diethylaminoethyl)-5-mercaptotetrazole
(33) 2-(5-Mercapto-1-tetrazolo)ethyltrimethylammonium Chloride
(34) 1-(3-Phenoxycarbonylphenyl)-5-mercaptotetrazole
(35) 1-(3-Maleimidophenyl)-6-mercaptotetrazole 2. Mercaptotriazole Compounds:

(1) 4-Phen-yl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole Compounds:

(1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole 4. Mercaptopyrimidine Compounds:

(1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Compounds:

(1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole 6. Mercaptothiadiazole Compounds:

(1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole 7. Mercaptobenzothiazole Compounds:

(1) 2-Mercaptobenzothiazole
(2) 5-Nitro-2-mercaptobenzothiazole
(3) 5-Carboxy-2-mercaptobenzothiazole
(4) 5-Sulfo-2-mercaptobenzothiazole 8. Mercaptobenzoxazole Compounds:

(1) 2-Mercaptobenzoxazole
(2) 5-Nitro-2-mercaptobenzoxazole
(3) 5-Carboxy-2-meroaptobenzoxazole
(4) 5-Sulfo-2-mercaptobenzoxazole 9. Benzotriazole Compounds:

(1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole, Sodium Salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole 10. Benzimidazole Compounds:

(1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole 11. Indazole Compounds:

(1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole 12. Tetrazole Compounds:

(1) 5-(4-Nitrophenyl)tetrazole
(2) 5-Phenyltetrazole
(3) 5-(3-Carboxyphenyl)tetrazole 13. Tetraazaindene Compounds:

(1) 4-Hydroxy-6-methyl-5-nitro-1,3,3a,7-tetraazaindene
(2) 4-Mercapto-6-methyl-5-nitro-1,3,3a,7-tetraazaindene 14. Mercaptoaryl Compounds:

(1) 4-Nitrothiophenol (2) Thiophenol (3) 2-Carboxythiophenol

In formula (I), V represents a carbonyl group,

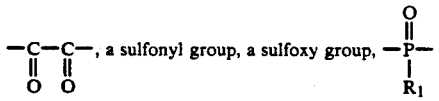

a sulfonyl group, a sulfoxy group, (wherein $R_1$ represents an alkoxy group or an aryloxy group), an iminomethylene group, or a thiocarbonyl group. V is preferably a carbonyl group.

The aliphatic group represented by R in formula (I) is a linear chain, branched, or cyclic alkyl group and the aliphatic group has preferably from 1 to 30 carbon atoms, and particularly preferably from 1 to 20 carbon atoms. Among them, the branched alkyl group may be cyclized to form a saturated heterocyclic ring having at least one hetero atom therein.

Examples thereof are methyl, t-butyl, n-octyl, t-octyl, cyclohexyl, hexenyl, pyrrolidyl, tetrahydrofuryl and n-dodecyl.

The aromatic group represented by R is a monocyclic or bicyclic aryl group such as a phenyl group, a naphthyl group, etc.

The heterocyclic group represented by R is a 3- to 10-membered saturated or unsaturated heterocyclic ring containing at least one of N, 0, and S, and the heterocyclic ring may be a single ring or may form a condensed ring with another aromatic ring or heterocyclic ring. The heterocyclic ring is preferably a 5- or 6-membered aromatic heterocyclic ring such as, for example, a pyridine ring, an imidazolyl group, a quinolinyl group, a benzimidazolyl group, a pyrimidinyl group, a pyrazolyl group, an isoquinolinyl group, a benzothiazolyl group, a thiazolyl group, etc.

The aforesaid groups represented by R may be substituted by a substituent group mentioned below and the substituent may be further substituted. Examples of substituents are an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an an alkylthio group, an arylthio group, a sulfonyl group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxy group, and a phosphoric acid amido group.

Also, in formula (I), R or -(Time$_r$-PUG may have a ballast group or a group that accelerates absorption to silver halide, both of which are used for immobile photographic additives such as couplers.

A ballast group is an organic group that gives a compound of formula (I) sufficient molecular weight to substantially prevent it from diffusing into other layer(s) or processing solutions. Examples of ballast groups are an alkyl group, an aryl group, a heterocyclic group, an ether group, a thioether group, an amido group, a ureido group, a urethane group, a sulfonamido group, and combinations of these groups. The ballast group is preferably a ballast group having a substituted benzene ring, and more preferably a ballast group having a benzene ring substituted by a branched alkyl group.

Specific examples of groups that accelerate absorption on silver halide are a cyclic thioamido group (such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-benzoxazoline-2-thione, benzothiazoline-2-thione, thiotriazine, and 1,3-imidazoline-2-thione); a chain-like thioamido group; an aliphatic mercapto group; an aromatic mercapto group; a heterocyclic mercapto group (when the atom adjacent to the carbon atom to which the -SH group is bonded is a nitrogen atom, the group is a tautomer of a cyclic thioamido group as described above); a group having a disulfide bond; a 5- or 6-membered nitrogen-containing heterocyclic group comprising a combination of nitrogen, oxygen, sulfur, and carbon (such as benzotriazole, triazole, tetrazole, indazole, benzimidazole, imidazole, benzothiazole, thiazole, thiazoline, benzoxazole, oxazole, oxazoline, thiadiazole, oxathiazole, triazine, and azaindene); and heterocyclic quaternary salts (such as benzimidazolinium).

These groups may be substituted by the substituents mentioned above for R.

Specific nonlimiting examples of redox compound usable in the present invention are illustrated below.

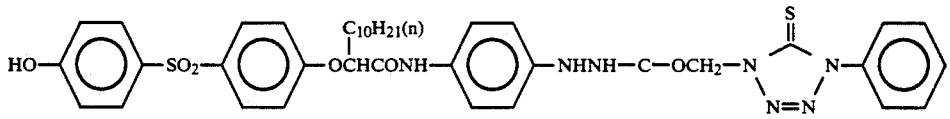

I-1.

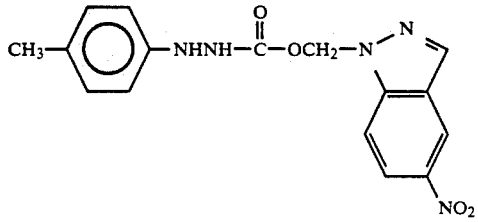

I-2.

-continued
I-3.
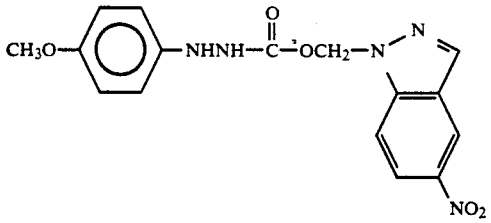
I-4.
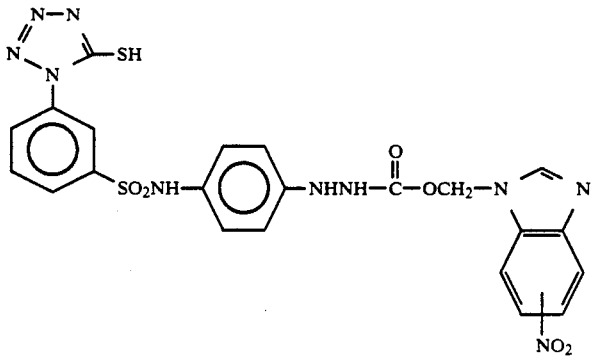
I-5.
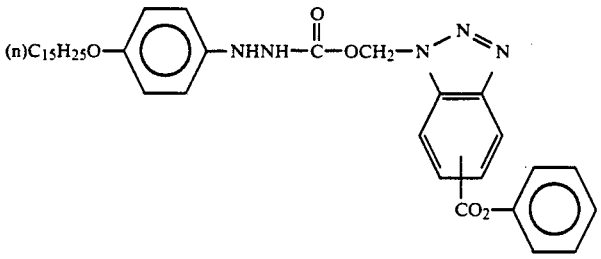
I-6.
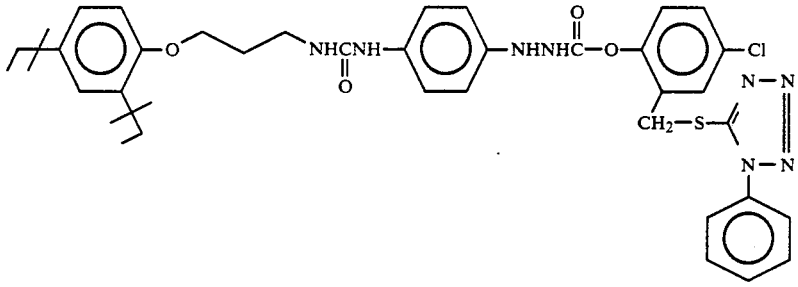
I-7.
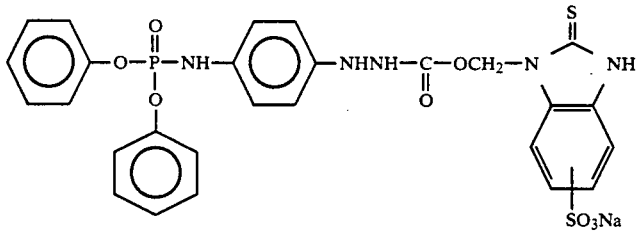
I-8.
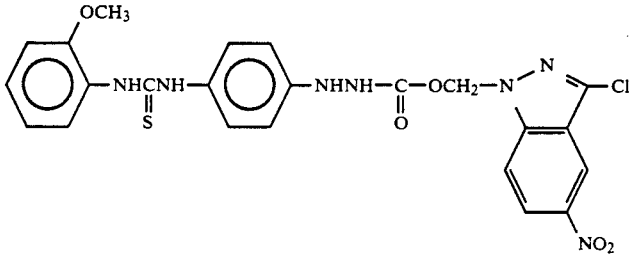

-continued
I-9.
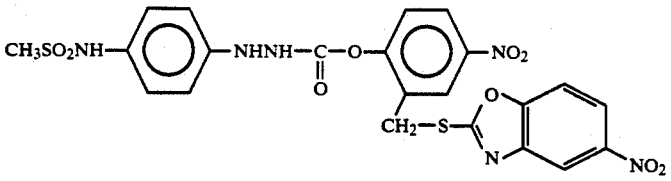
I-10.
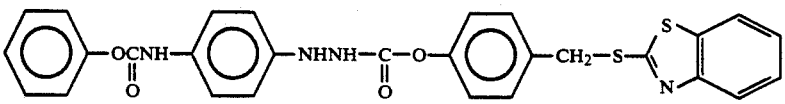
I-11.
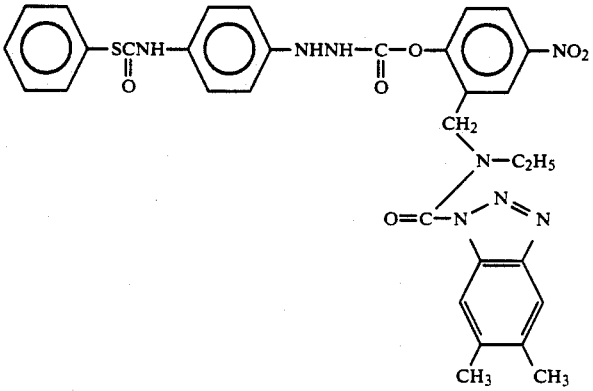
I-12.
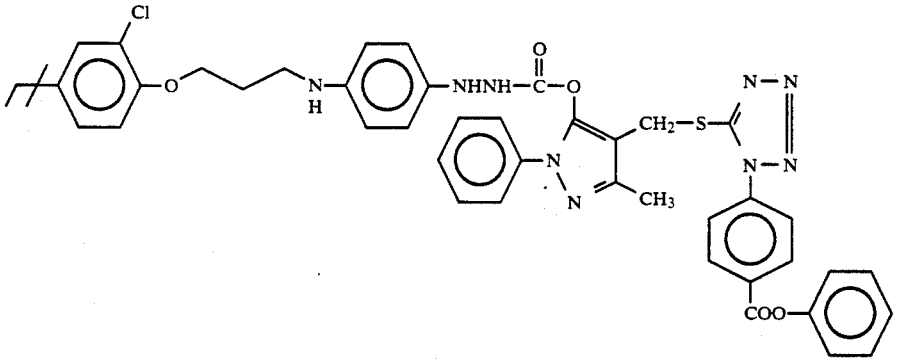
I-13.
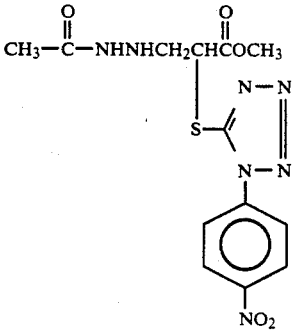

-continued
I-14.
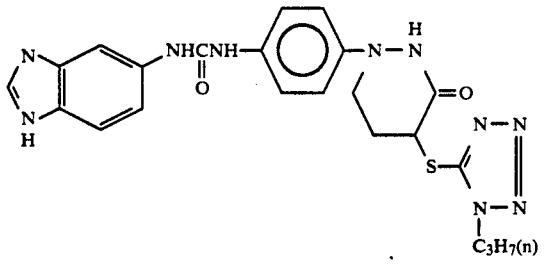
I-15.
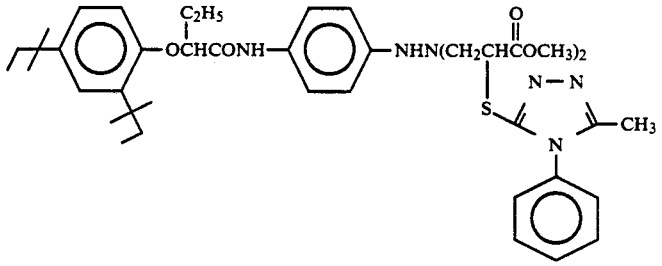
I-16.
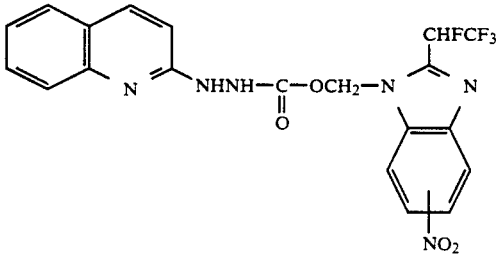
I-17.
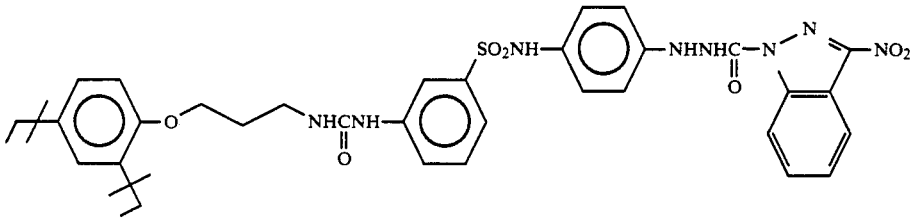
I-18.
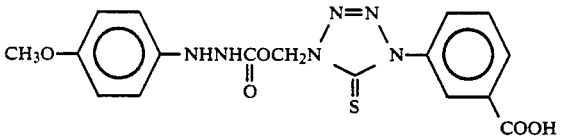
I-19.
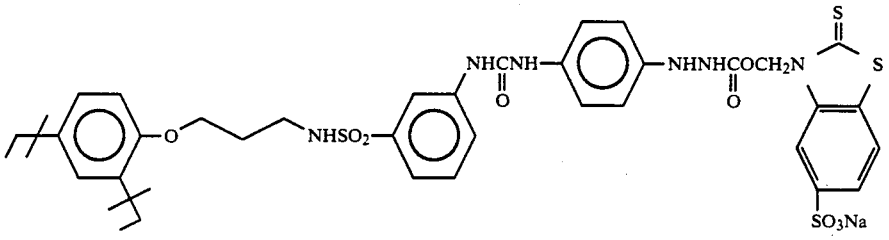
I-20.
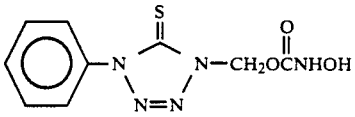

-continued
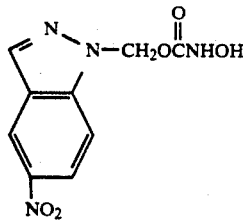
I-21.
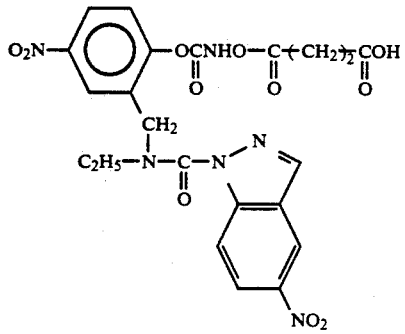
I-22.
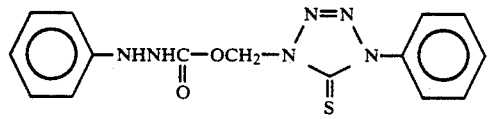
I-23
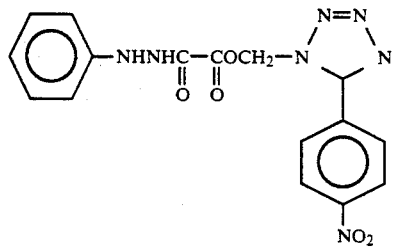
I-24
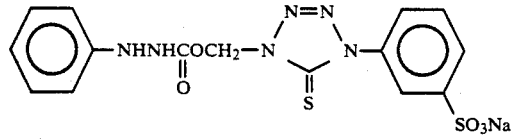
I-25.
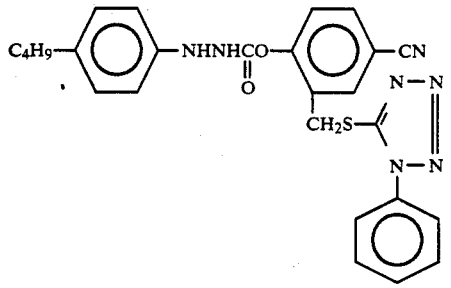
I-26.
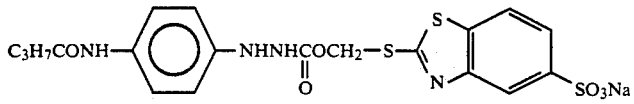
I-27.

-continued
I-28.
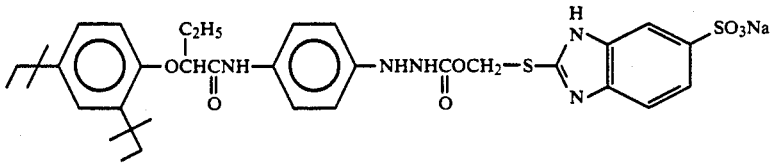
I-29.
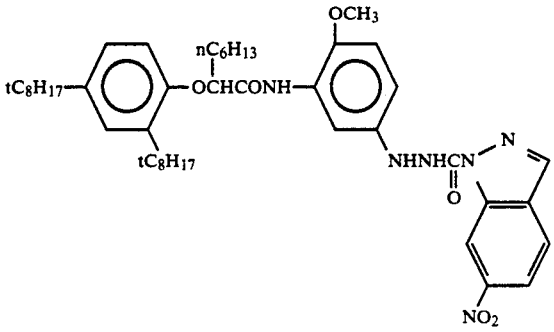
I-30.
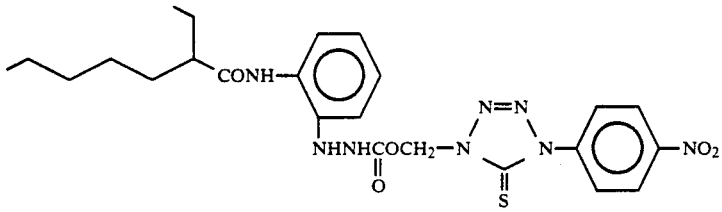
I-31.
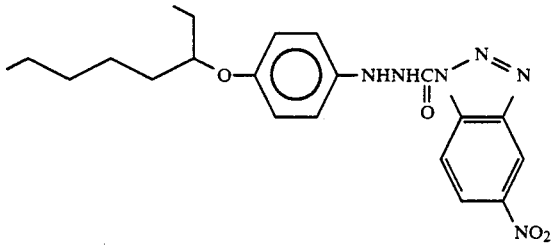
I-32.
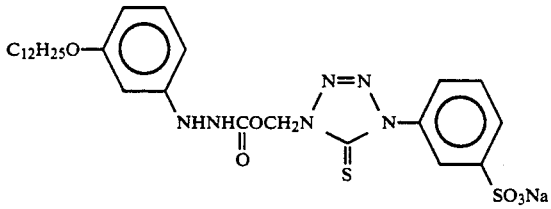
I-33.
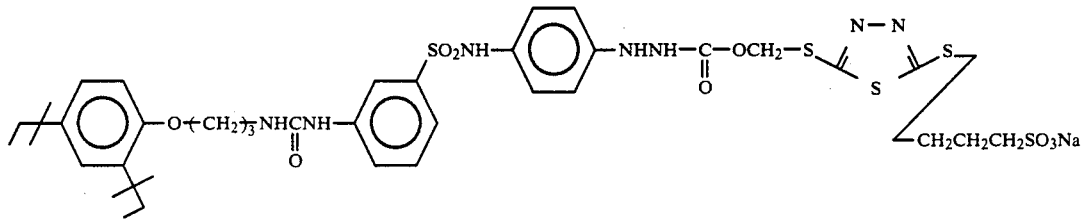

-continued
I-34.
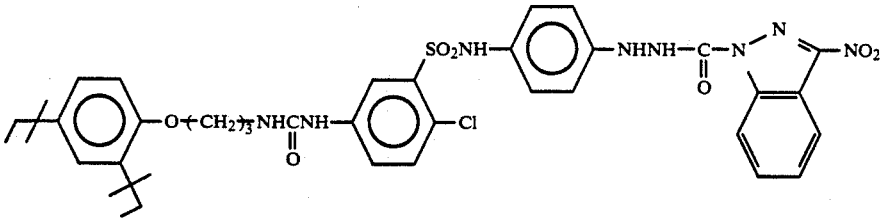
I-35.
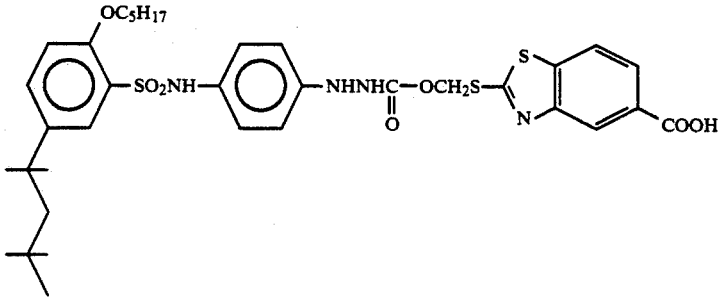
I-36.
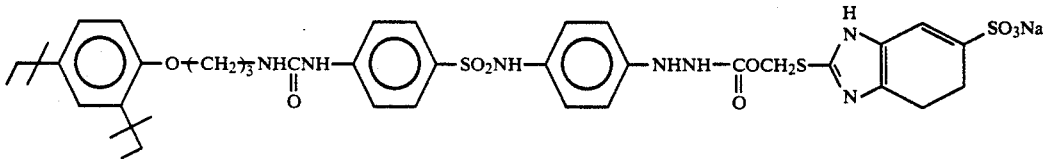
I-37.
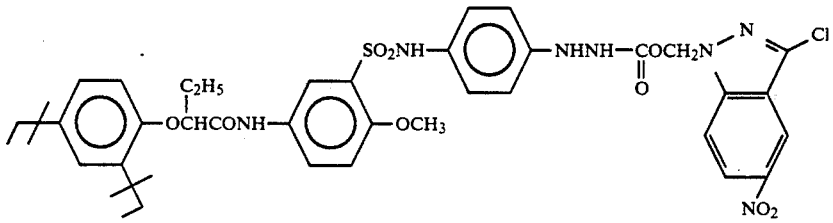
I-38.
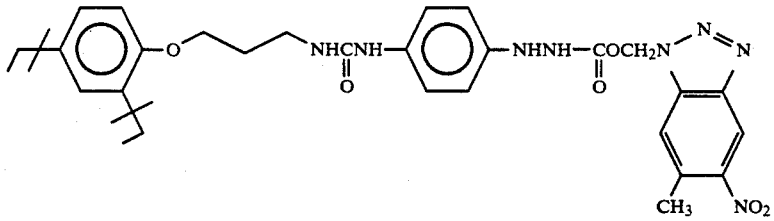
I-39.
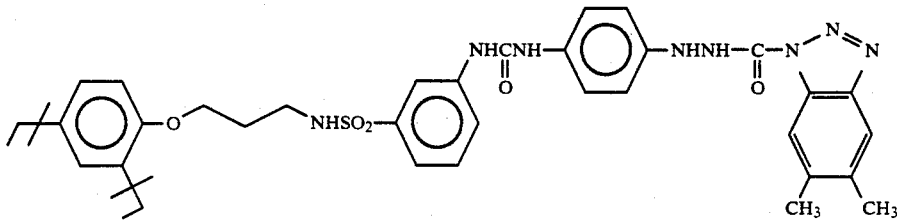

-continued
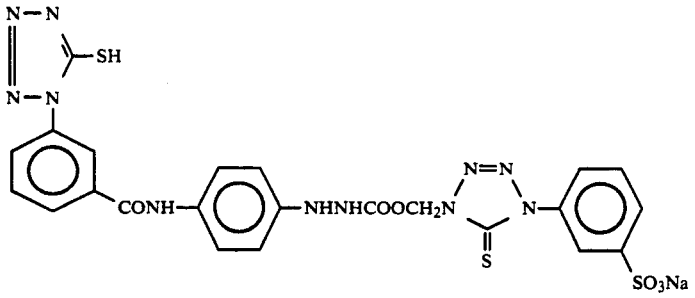
I-40.
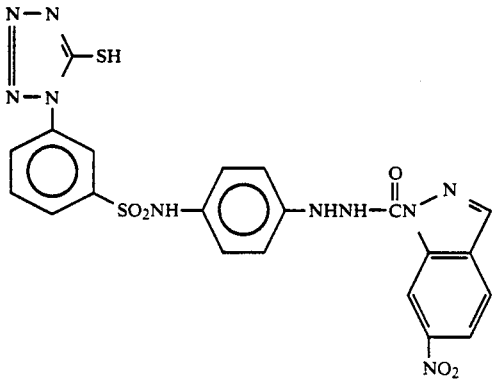
I-41.
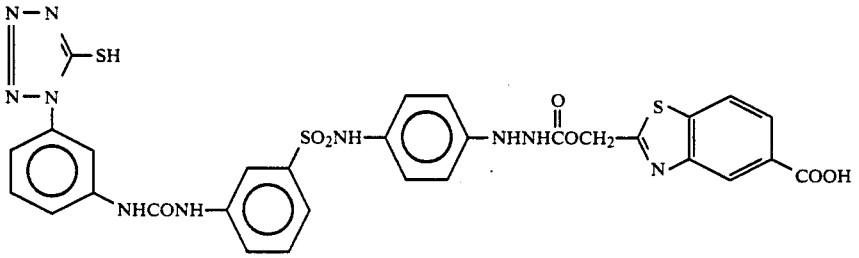
I-42.
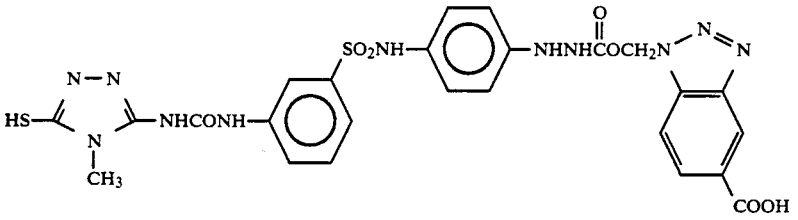
I-43.
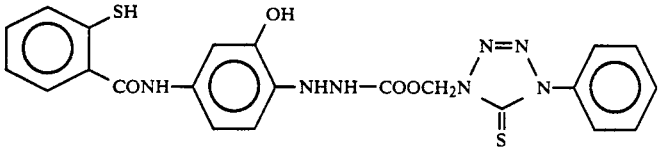
I-44.

-continued
I-45.
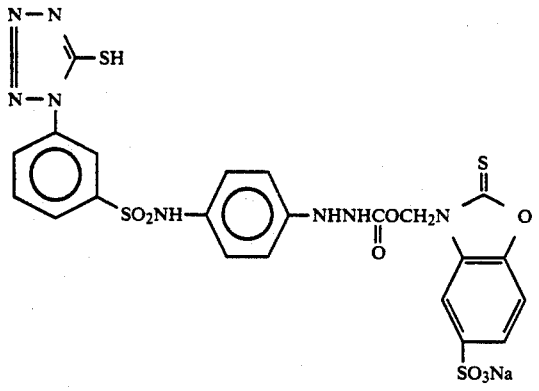
I-46.
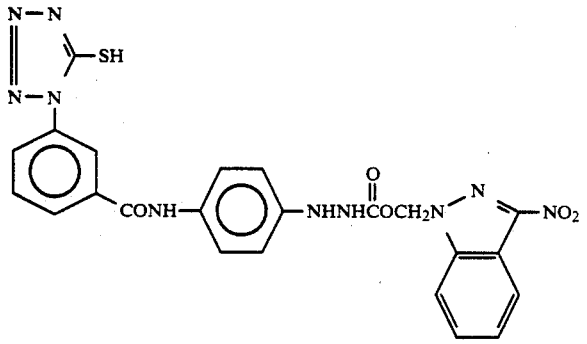
I-47.
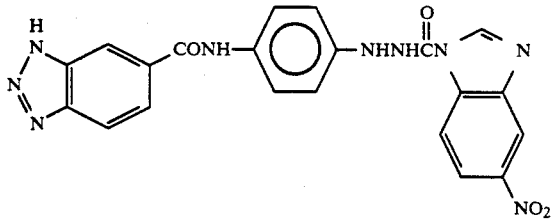
I-48.
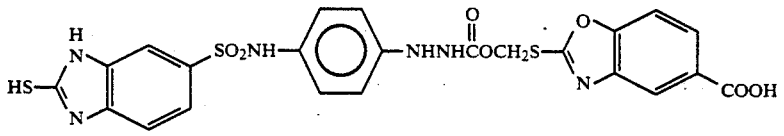
I-49.
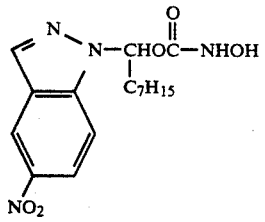
I-50.
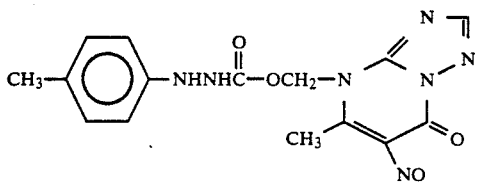

-continued
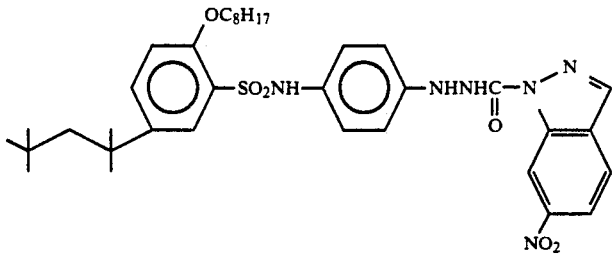
I-51.
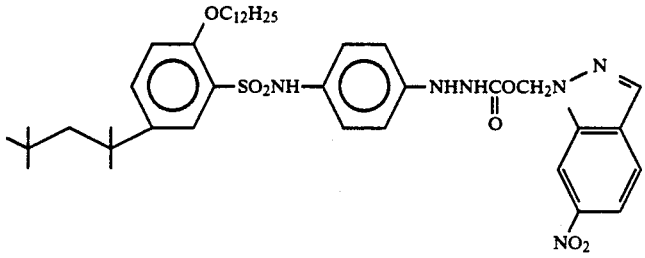
I-52.
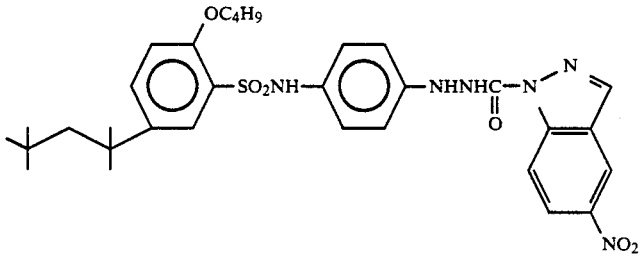
I-53.
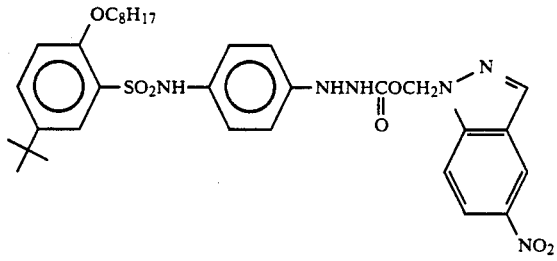
I-54
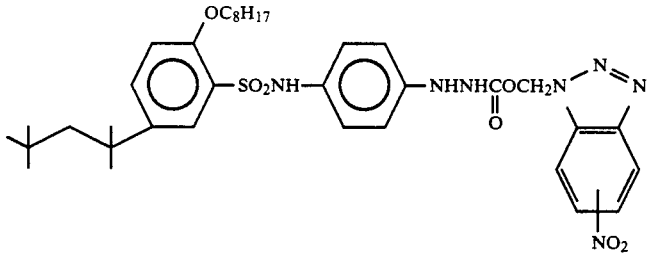
I-55.
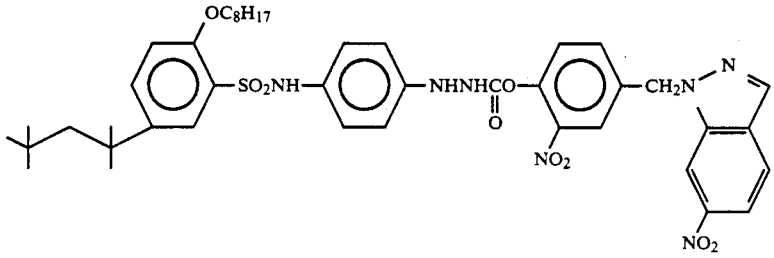
I-56.

-continued

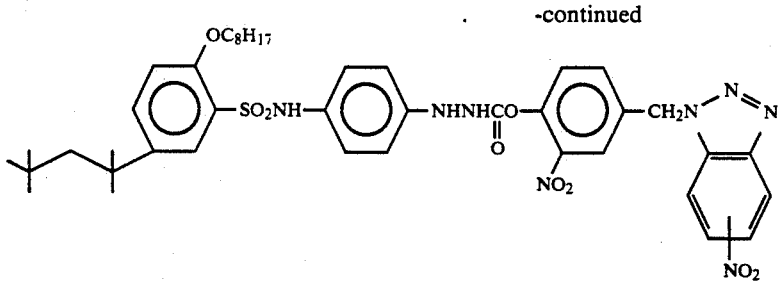

I-57.

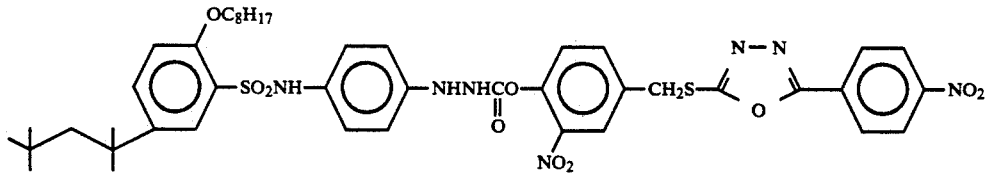

I-58.

Synthesis methods for the redox compounds used in the present invention are described in U.S. Pat. Nos. 3,379,529, 3,620,746, 4,377,634, 4,332,878 and 4,684,604, JP-A-61-213847, JP-A-62-260153, JP-A-49-129536, JP-A-56-153336, JP-A-56-153342, and JP-A-1-269936.

The amount of redox compound used in the present invention is from about $1.0\times10^{-6}$ to about $5.0\times10^{-2}$ mol, preferably from about $1.0\times10^{-5}$ to about $1.0\times10^{-2}$ mol, per mol of silver halide.

The redox compound in the present invention can be used as a solution in a proper water-miscible organic solvent such as alcohol (e.g., methanol, ethanol, propanol, and fluorinated alcohols); ketone (acetone and methyl ethyl ketone); dimethylformamide; dimethyl sulfoxide; or methyl cellosolve.

Also, the redox compound can be dissolved in an oil (such as dibutyl phthalate, tricresyl phosphate, glyceryl triacetate, and diethyl phthalate) by using an auxiliary solvent (such as ethyl acetate and cyclohexanone) and mechanically formed into an emulsified dispersion according to any known emulsion dispersion method. Furthermore, a powder of the redox compound can be dispersed in water by using a ball mill, a colloid mill, or super sonic wave using the solid dispersion method.

In the present invention, as a method of forming images having a gradation of at least 10, various known methods or systems can be used.

For example, a system using a silver halide photographic emulsion is known and in the system, a negative image is usually obtained:

1) The method of processing a lithographic (lith type) silver halide photographic material containing silver chlorobromide with a lith developer (i.e., a hydro-quinone developer having a sulfite ion concentration of less than 0.1 mol/liter, known as a lithographic development (lith development) system);

2) The method of obtaining a high contrast image by processing lith type silver halide photographic material with a hydroquinone developer having a sulfite concentration of 0.2 mol/liter or higher and a pH of 10.5 or higher, that contains a nitroindazole series compound (see JP-A-58-190943) (hereinafter, FSL development system);

3) The method of obtaining high contrast by processing photographic light-sensitive material containing a tetrazolium compound with a PQ-type or MQ-type developer containing sulfite at a relatively high concentration (disclosed in JP-A-52-18317, JP-A-53-17719, and JP-A-53-17720) (hereinafter, tetrazolium high contrast development system); The method of obtaining a super-high contrast negative images by processing a surface latent image type silver halide photographic material containing a hydrazine derivative (e.g., specific acylhydrazine compounds as described in U.S. Pat. Nos. 4,166,742, 4,168,977, 4,221,857, 4,224,401, 4,243,739, 4,272,606, and 4,311,781) with a processing solution having a pH of from 11.0 to 12.3 containing at least 0.15 mol/liter of a sulfite preservative) (herein-after, hydrazine contrast development system);

5) The method of forming safelight-sensitive material by adding an inorganic desensitizer (such as a rhodium salt, an iridium salt, or a cupric chloride); an organic desensitizer (such as pinakryptol yellow or phenosafranine); or a safelight dye (i.e., a dye having spectral absorption in the region of the long wavelength-side of the silver halide.

The amount of inorganic desensitizer added to the silver halide emulsion of the present invention to form safelight-sensitive materials is preferably at least $1\times10^{-6}$ mol per mol of silver; most preferably from $1\times10^{-6}$ to $1\times10^{-3}$ mol per mol of silver. The amount of the aforesaid organic desensitizer added is preferably at least $1\times10^{-5}$ mol per mol of silver; most preferably from $1\times10^{-5}$ to $1\times10^{-2}$ mol per mol of silver. Details of methods for making safelight-sensitive materials using desensitizers are described further in JP-A-58-190943 and JP-A-59-157630.

The method of making safelight-sensitive materials using dyes can be practiced in the present invention by incorporating dyes having an absorption maximum in the range of from 400 nm to 550 nm in the light-sensitive materials (described in JP-A-62-67530 in detail).

By combining the aforesaid method and the aforesaid development system, the light-sensitive material for light-room having a $\tau$ value of at least 10, which is used for attaining the object of the present invention, can be achieved.

Imagewise exposure of the light-sensitive silver halide emulsion layer to light having no wavelengths of less than 370 nm can be done by 1) incorporating an ultraviolet absorbent into the light-sensitive material, 2) using an optical filter absorbing ultraviolet rays, or 3) using a light source having substantially no emitted light of less than 370 nm.

The ultraviolet absorbent is used in the present invention in an amount capable of reducing the original intrinsic sensitivity of the silver halide emulsion by 50%.

Such ultraviolet absorbents preferably have an absorption peak of from 300 nm to 400 nm; more preferably from 300 nm to 380 nm.

Examples of ultraviolet absorbent are benzotriazole compounds substituted by an aryl group; 4-thiazolidone compounds; benzophenone compounds; cinnamic acid ester compounds; butadiene compounds; benzoxazole compounds; and ultraviolet absorbing polymers.

Specific examples of ultraviolet absorbent are described in U.S. Patents 3,533,794, 3,314,794, 3,352,681, 3,705,805, 3,707,375, 4,045,229, 3,700,455, and 3,499,762, JP-A-46-2784, and West German Patent (OS) 1,547,863.

Specific nonlimiting examples of ultraviolet absorbent for use in the present invention are illustrated below.

U-1

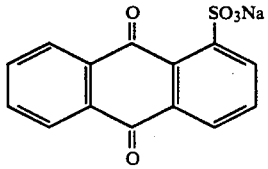

U-2

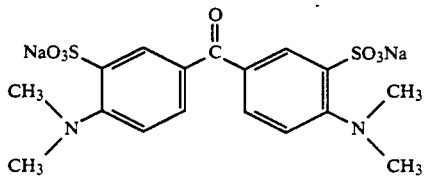

U-3

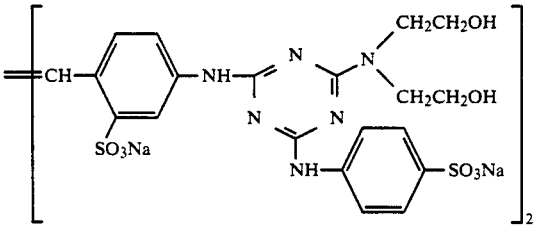

U-4

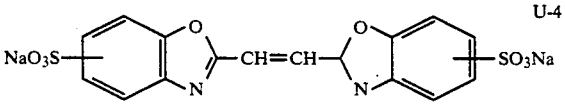

U-5

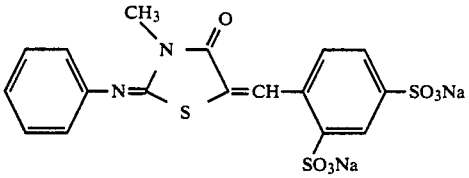

U-6

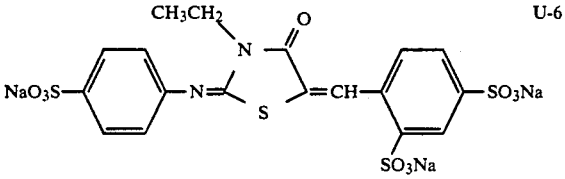

U-7

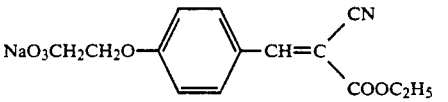

-continued

U-8

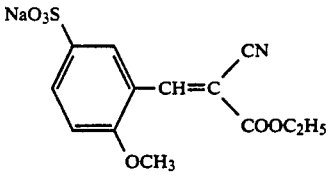

U-9

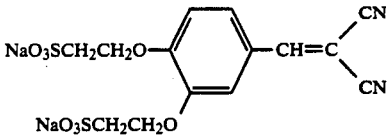

U-10

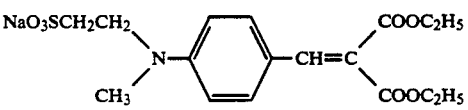

U-11

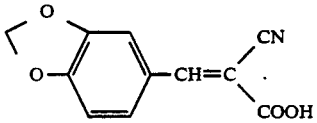

U-12

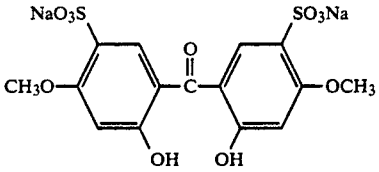

U-13

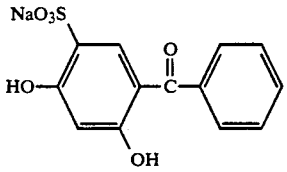

U-14

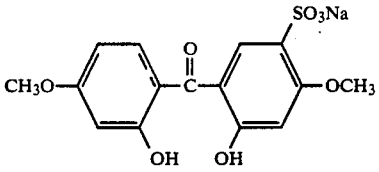

U-15

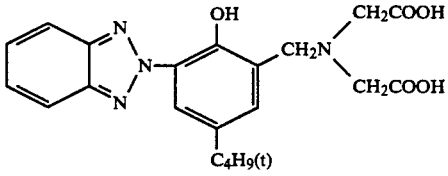

U-16

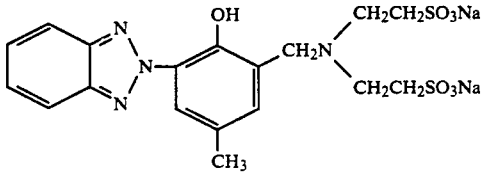

-continued

U-17

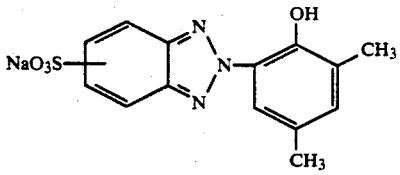

U-18

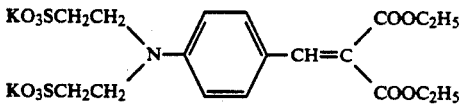

U-19

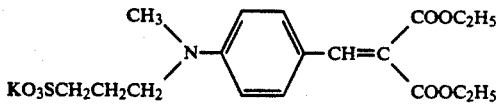

U-20

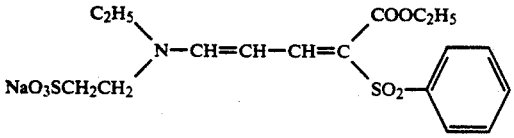

U-21

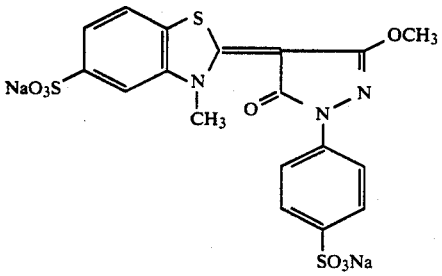

U-22

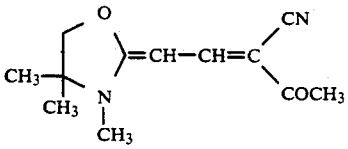

U-23

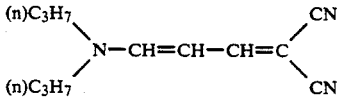

U-24

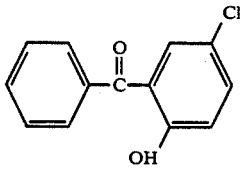

U-25

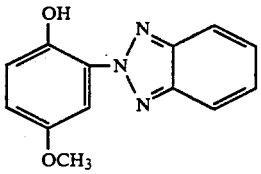

U-26

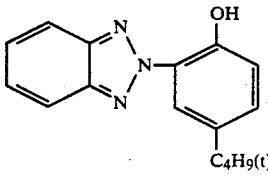

-continued

U-27

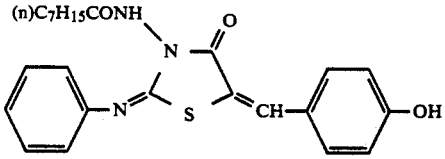

U-28

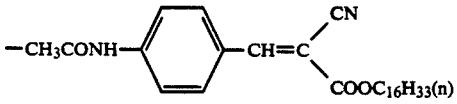

U-29

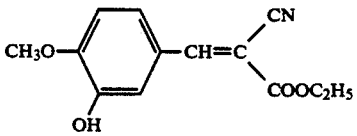

U-30

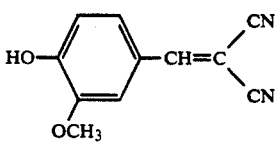

More specifically, the ultraviolet absorbent is added so that the specific sensitivity of the silver halide emulsion at 360 nm is reduced by more than 50%. Preferably, the amount added is such that the absorbance at 360 nm becomes at least 0.3; more preferably such that the absorbence at 360 nm becomes at least 0.4.

The amount of ultraviolet absorbent added differs according to the molar extinction coefficient for the specific compound. However, the amount added is generally in the range of from about $10^{-2}$ g/m$^2$ to about 1 g/m$^2$; preferably from about 50 mg/m$^2$ to about 500 mg/m$^2$.

The ultraviolet absorbent can be incorporated in the silver halide emulsion layer, a surface protection layer, or an interlayer, for example.

The ultraviolet absorbent can be added to a coating composition for a hydrophilic colloid layer as a solution in a solvent such as water, alcohol (e.g., methanol, ethanol, and propanol), acetone, methyl cellosolve, or a mixture of such solvents.

Ultraviolet absorbents can be used separately or in combinations with each other.

In the present invention, dyes for making safelight-sensitive materials and ultraviolet absorbent may be present in the same layer or in separate layers.

Useful optical filters for absorbing ultraviolet rays (i.e., light source filter) are filters that scarcely transmit light having a wavelength of less than 370 nm. Examples of these are sold as "Sharp Cut Filters SC-38, SC-39, SC-40, and SC-41" by Fuji Photo Film Co., Ltd. The permeability of useful optical filters is preferably 20% or lower; more preferably 10% or lower.

Light sources that emit substantially light having no wavelengths less than 370 nm are sold under the trade name "Eye Dolphin" (by Eye Glass Fix Co., Ltd.), sold as the light source (metal halide lamp) for the P-603 plate making printer (made by Dainippon Screen Mfg. Co., Ltd.), and sold as "SPG-2000 (2 kw)" (by Japan Storage Battery Co., Ltd.). Useful light sources emit light of from 300 nm to 420 nm in wavelength, and the emitted light energy in the range of from 300 nm to 370 nm in useful lights is preferably 30% or less; most preferably 20% or less.

In the present invention, commercially available safelight-sensitive materials (e.g., "KUV-100" made by Fuji Photo Film Co., Ltd., and "CRH-100" made by Konica Corporation) may be exposed with an ordinary high capacity light source combined with an optical filter that eliminates ultraviolet rays. An example of such a high capacity light source is the high pressure mercury lamp "H-15-L31" (15 kw) (made by Eye Graphic Co., Ltd.).

Exposing the safelight-sensitive material through the UV filter means that substantially all the light reaching the material is the light having no wavelengths of less than 370 nm.

If one of the layers of the photographic material contains an ultraviolet absorbent, exposure can be made using a conventional light source without a filter. Examples of such light sources are the high pressure mercury lamp "ORC-CHM-1000" manufactured for the plate making printer "P-607" or "P-627" by Dainippon Screen Mfg. Co.

In the present invention, exposure time depends upon the capacity of a light source being used, the light sensitivity, including spectral sensitivity, of the light-sensitive material among other factors. In general, however, the exposure time is usually from 5 seconds to 60 seconds. Under certain circumstances, the exposure time may be longer, for example, from 2 to 3 minutes.

Examples of hydrazine derivatives useful for the hydrazine contrast development system in the present invention are arylhydrazides having a sulfinic acid residue bonded to the hydrazo moiety (as described in U.S. Pat. No. 4,478,928), as well as the compounds represented by formula (II):

$$R_1—NHNH—G—R_2 \quad (II)$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfoxy group, a phosphoryl group, or an N-substituted or unsubstituted iminomethylene group.

In formula (II), the aliphatic group represened by $R_1$ preferably has from 1 to 30 carbon atoms, and is particularly preferably a straight chain, branched, or cyclic alkyl group having from 1 to 20 carbon atoms. In this case, the branched alkyl group may be cyclized to form a saturated heterocyclic ring containing at least one hetero atom. Also, the alkyl group may have a substituent such as an aryl group, an alkoxy group, a sulfoxy group, a sulfonamido group, or a carbonamido group.

In formula (II), the aromatic group represented by $R_1$ is a monocyclic or dicyclic aryl group or an unsaturated heterocyclic group. The unsaturated heterocyclic group may form a heterocyclic aryl group by condensing with a monocyclic or dicyclic aryl group.

Examples of such aromatic groups are a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Among these, those containing a benzene ring are preferred.

$R_1$ is most preferably an aryl group.

The aryl group or the unsaturated heterocyclic group represented by $R_1$ may be substituted and the typical substituents include a straight chain, branched, or cyclic alkyl group (preferably having from 1 to 20 carbon atoms), an aralkyl group (preferably a monocyclic or dicyclic aralkyl group the alkyl moiety of which has from 1 to 3 carbon atoms), an alkoxy group (preferably having from 1 to 20 carbon atoms), a substituted amino group (preferably an amino group substituted by an alkyl group having from 1 to 20 carbon atoms), an acylamino group (preferably having from 2 to 30 carbon atoms), a sulfonamido group (preferably having from 1 to 30 carbon atoms), and a ureido group (preferably having from 1 to 30 carbon atoms).

In formula (II), the alkyl group represented by $R_2$ preferably has from 1 to 4 carbon atoms and may be substituted, for example, by a halogen atom, a cyano group, a carboxy group, a sulfo group, an alkoxy group, or a phenyl group.

The substituted or unsubstituted aryl group shown by $R_2$ in formula (II) is a monocyclic or dicyclic aryl group and contains, for example, a benzene ring. The aryl group may be substituted, for example, by a halogen atom, an alkyl group, a cyano group, a carboxy group, or a sulfo group.

In formula (II), the alkoxy group represented by $R_2$ has from 1 to 8 carbon atoms and may be substituted, for example, by a halogen atom or an aryl group.

The aryloxy group represented by $R_2$ is preferably a monocyclic group and may be substituted, for example, by a halogen atom.

When G is a carbonyl group, $R_2$ is preferably a hydrogen atom, methyl, methoxy, ethoxy, substituted or unsubstituted phenyl group; most preferably a hydrogen atom.

When G is a sulfonyl group, $R_2$ is preferably a methyl, ethyl, phenyl, or 4-methylphenyl group; most preferably a methyl group.

When G is a phosphoryl group, $R_2$ is preferably a methoxy, ethoxy, butoxy, phenoxy, or phenyl group; most preferably a phenoxy group.

When G is a sulfoxy group, $R_2$ is preferably a cyanobenzyl or methylthiobenzyl group; and when G is an N-substituted or unsubstituted iminomethylene group, $R_2$ is preferably a methyl, ethyl, or substituted or unsubstituted phenyl group.

In formula (II), $R_1$ or $R_2$ may contain a ballast group; such ballast groups are generally used for immobile photographic additives such as couplers. A ballast group generally has at least 8 carbon atoms and is relatively inactive in terms of photographic properties. Examples of ballast groups are an alkyl group, an alkoxy group, a phenyl group, an alkylphenyl group, a phenoxy group, and an alkylphenoxy group.

In formula (II), $R_1$ or $R_2$ may have incorporated a group capable of promoting their adsorption onto the surface of the silver halide grains. Such absorptive groups are a thiourea group, a heterocyclic thioamido group, a mercapto heterocyclic group, or a triazole group. These are described in U.S. Pat. No. 4,385,108.

G in formula (II) is most preferably a carbonyl group.

Specific nonlimiting examples of the compound represented by formula (II) are illustrated below.

II-1)
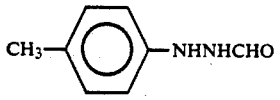
II-2)
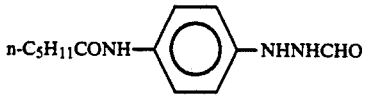
II-3)
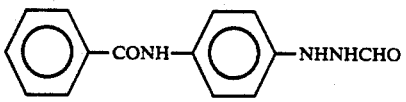
II-4)
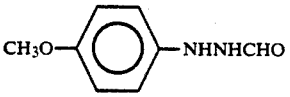
II-5)
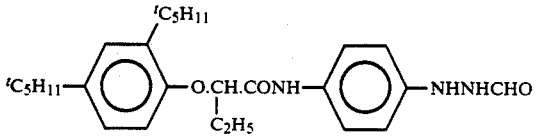
II-6)
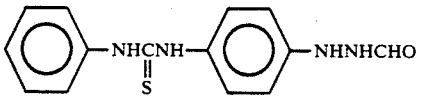
II-7)
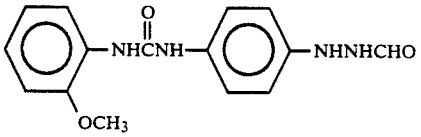
II-8)
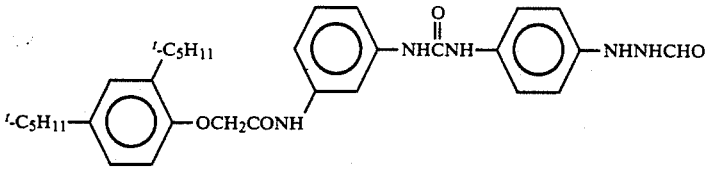
II-9)
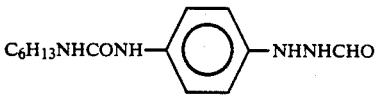
II-10)
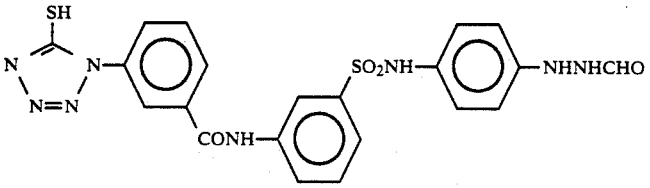
II-11)

-continued
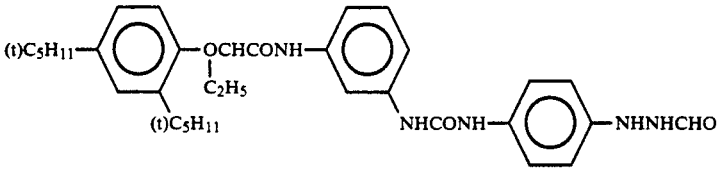
II-12)
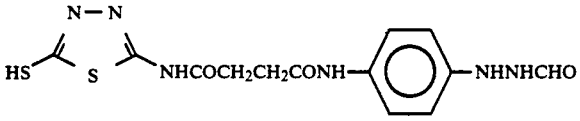
II-13)
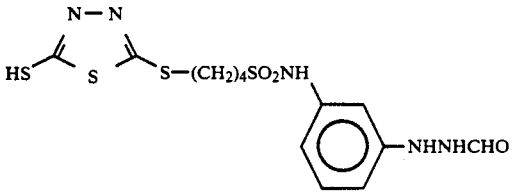
II-14)
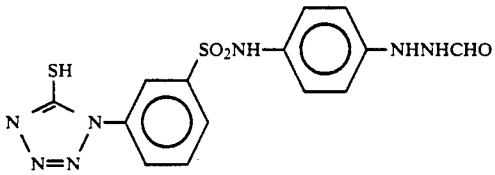
II-15)
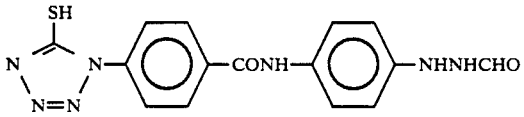
II-16)
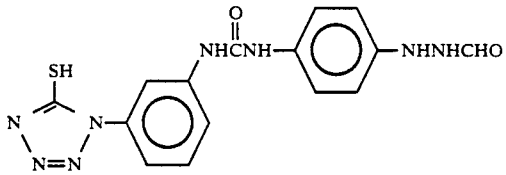
II-17)
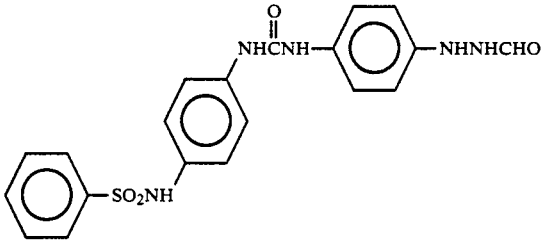
II-18)
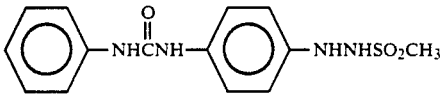
II-19)

-continued
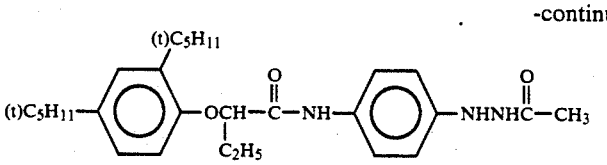
II-20)
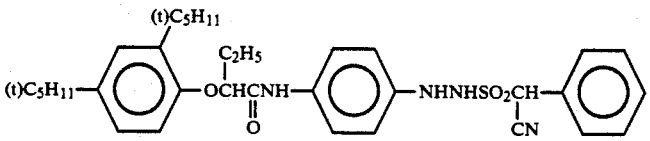
II-21)
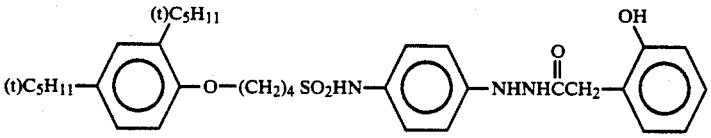
II-22)
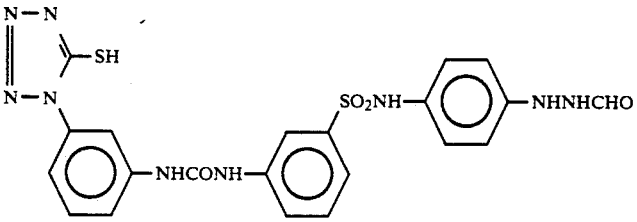
II-23)
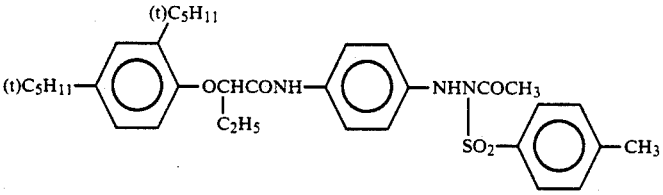
II-24)
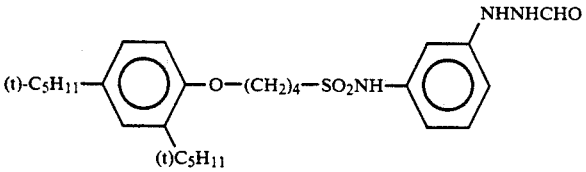
II-25)
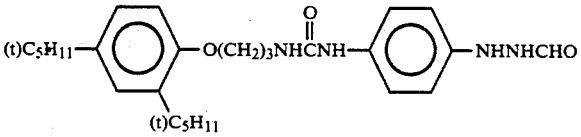
II-26)
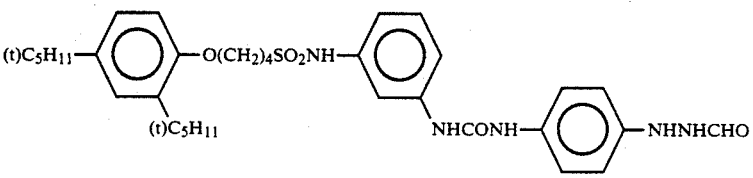
II-27)

-continued
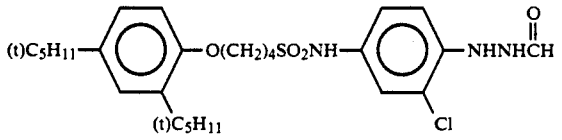
II-28)
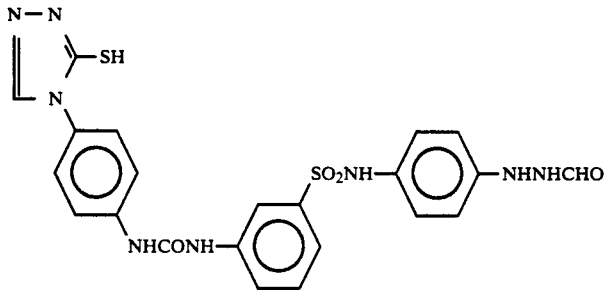
II-29)
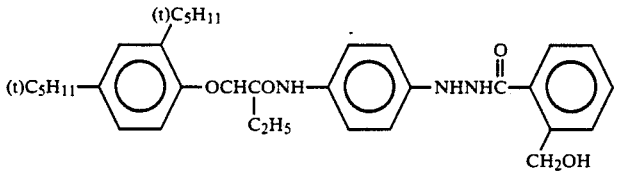
II-30)
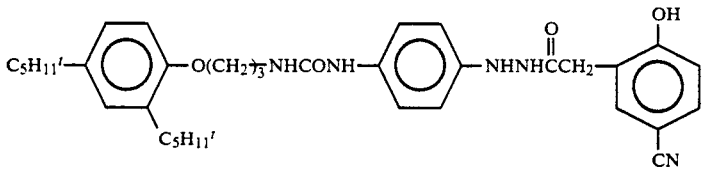
II-31)
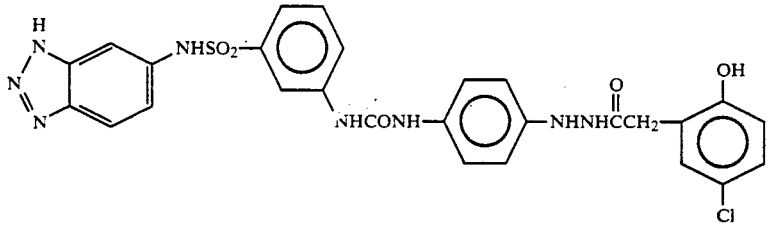
II-32)
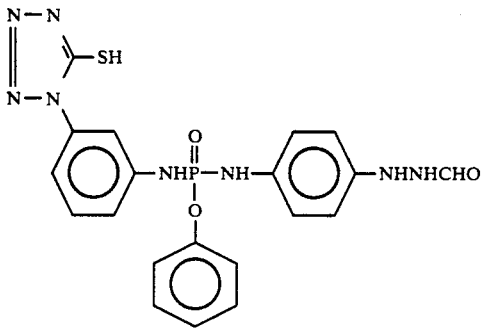
II-33)

-continued

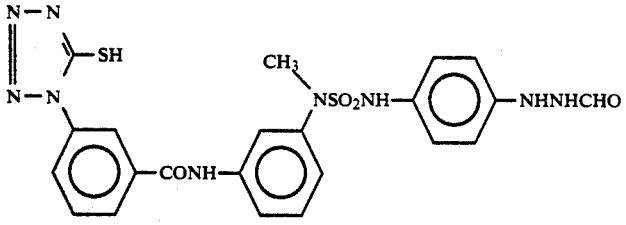

II-34)

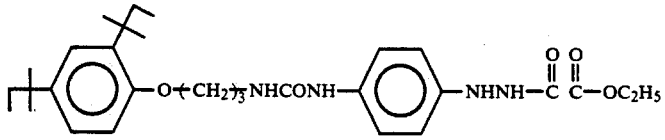

II-35)

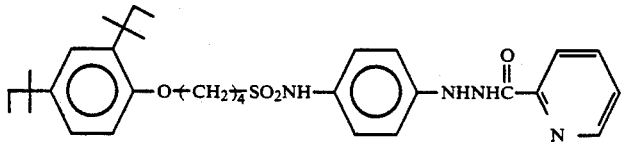

II-36)

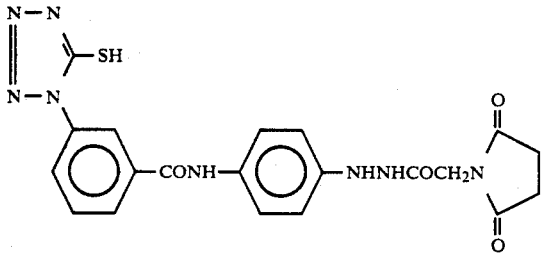

In addition to the aforesaid compounds, other hydrazine derivatives that can be used in the present invention are described in *Research Disclosure*, Item 23516, page 346 (November, 1983), U.S. Pat. No. 4,080,207, 4,269,929, 4,276,364, 4,278,748, 4,385,108, 4,459,347, 4,560,638, and 4,478,928, British Patent 2,011,391B, JP-A-60-179734, JP-A-62-270948, JP-A-63-29751, JP-A-61-170733, JP-A-61-270744, JP-A-62-948, JP-A-62-178246, JP-A-63-234244, JP-A-63-234245, JP-A-63-234246, JP-A-63-294552, JP-A-63-306438, JP-A-63-32538, JP-A-63-4047, JP-A-63-121838, JP-A-63-129337, JP-A-63-223744, Japanese Patent Application Nos. 62-246478, 63-147339 63-179760, 63-229163, 1-18377, 1-18378, 1-18379, 1-15755, 1-16814, 1-40782, 1-42615, and 1-42616, JP-A-63-294522, JP-A-63-306448, JP-A-1-10233, JP-A-1-276128, JP-A-1-283548, JP-A-1-280747, JP-A-1-283549, JP-A-1-285940, European Patent 217,310, and U.S. Patent 4,686,167.

The hydrazine derivative is preferably incorporated in the silver halide emulsion layer but may be incorporated in any other light-insensitive hydrophilic colloid layer such as a protective layer, an interlayer, a filter layer, an antihalation layer.

When the hydrazine derivative being used is water-soluble, it may be added to an aqueous hydrophilic colloid solution as an aqueous solution. When it is sparingly soluble in water, it may be added as a solution of an organic solvent miscible with water, such as an alcohol, an ester, or a ketone.

When the hydrazine derivative is incorporated into the silver halide emulsion layer, it may be added to the emulsion at any time from the initiation of chemical ripening of the emulsion to coating the emulsion. It is preferred that the hydrazine derivative be added in the period after finishing chemical ripening and before coating. The compound is most preferably added to the coating composition just before coating.

In the present invention, the hydrazine derivative represented by formula (II) is incorporated in the silver halide emulsion or other coating composition in an amount of from about $1\times10^{-6}$ mol to about $1\times10^{-1}$ mol; preferably from about $1\times10^{-5}$ mol to about $4\times10^{-3}$ mol per mol of the silver halide in the silver halide emulsion.

Examples of the tetrazolium compound useful for the tetrazolium contrast development system that when included in the light-sensitive material of the present invention yield high contrast are described in JP-A-52-18317, JP-A-53-17719, and JP-A-53-17720. Typical tetrazolium compounds used in the present invention are represented by formulae (IV), (V) and (VI):

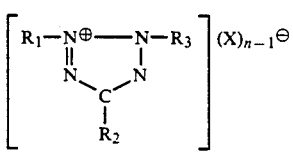

(IV)

-continued

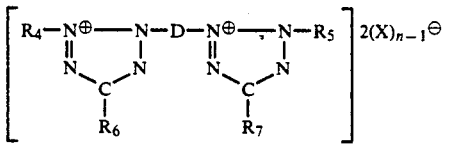

(V)

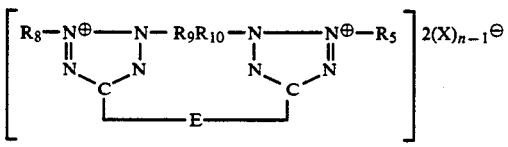

(VI)

wherein $R_1$, $R_3$, $R_4$, $R_5$, $R_8$, $R_9$, $R_{10}$, and $R_{11}$ each represents an allyl group, a phenyl group (e.g., phenyl, tolyl, hydroxyphenyl carboxyphenyl aminophenyl and mercaptophenyl), a naphthyl group (e.g., α-naphthyl, β-naphthyl, hydroxynaphthyl, carboxynaphthyl, and aminonaphthyl), or a heterocyclic group (e.g., thiazolyl, benzothiazolyl, oxazolyl, pyromidinyl, and pyridyl), and these groups may form a metal chelate or a complex; $R_2$, $R_6$, and $R_7$ each represents an allyl group, a phenyl group, a naphthyl group, a heterocyclic group, an alkyl group (e.g., methyl, ethyl, propyl, butyl, mercaptomethyl, and mercaptoethyl), a hydroxy group, a carboxy group or a salt of a carboxy group, a carboxyalkyl group (e.g., methoxycarbonyl and ethoxycarbonyl), an amino group (e.g., amino, ethylamino, and anilino), a mercapto group, a nitro group, or a hydrogen atom; D represents a divalent aromatic group; E represents an alkylene group, an arylene group, or an aralkylene group; and n represents 1 or 2, when n is 1, the compound of the formula forms an intramolecular salt; X represents an anion.

Specific examples of useful tetrazolium compounds are given below, but the present invention is not limited to these compounds.

(1) 2-(Benzothiazol-2-yl)-3-phenyl-5-dodecyl-2H-tetrazolium bromide
(2) 2,3-Diphenyl-5-(4-t-octyloxyphenyl)-2H-tetrazolium chloride
(3) 2,3,5-Triphenyl-2H-tetrazolium (4) 2,3,5-Tri(p-carboxyethylphenyl)-2H-tetrazolium
(5) 2-(Benzothiazol-2-yl)-3-phenyl-5-(o-chlorophenyl)-2H-tetrazolium
(6) 2,3-Diphenyl-2H-tetrazolium
(7) 2,3-Diphenyl-5-methyl-2H-tetrazolium
(8) 3-(p-Hydroxyphenyl)-5-methyl-2-phenyl-2H-tetrazolium
(9) 2,3-Diphenyl-5-ethyl-2H-tetrazolium
(10) 2,3-Diphenyl-5-n-hexyl-2H-tetrazolium
(11) 5-Cyano-2,3-diphenyl-2H-tetrazolium
(12) 2-(Benzothiazol-2-yl)-5-phenyl-3-(4-tolyl)-2H-tetrazolium
(13) 2-(Benzothiazol-2-yl)-5-(4-chlorophenyl)-3-(4-nitrophenyl)-2H-tetrazolium
(14) 5-Ethoxycarbonyl-2,3-di(3-nitrophenyl)-2H-tetrazolium
(15) 5-Acetyl-2,3-di(p-ethoxyphenyl)-2H-tetrazolium
(16) 2,5-Diphenyl-3-(p-tolyl)-2H-tetrazolium
(17) 2,5-Diphenyl-3-(p-iodophenyl)-2H-tetrazolium
(18) 2,3-Diphenyl-5-(p-diphenyl)-2H-tetrazolium
(19) 5-(p-Bromophenyl)-2-phenyl-3-(2,4,6-trichlorophenyl)-2H-tetrazolium
(20) 3-(p-Hydroxyphenyl)-5-(p-nitrophenyl)-2-phenyl-2H-tetrazolium
(21) 5-(3,4-Dimethoxyphenyl)-3-(2-ethoxyphenyl)-2-(4-methoxyphenyl)-2H-tetrazolium
(22) 5-(4-Cyanophenyl)-2,3-diphenyl-2H-tetrazolium
(23) 3-(p-Acetamidophenyl)-2,5-diphenyl-2H-tetrazolium
(24) 5-Acetyl-2,3-diphenyl-2H-tetrazolium
(25) 5-(Fur-2-yl)-2,3-diphenyl-2H-tetrazolium
(26) 5-(Thien-2-yl)-2,3-diphenyl-2H-tetrazolium
(27) 2,3-Diphenyl-5-(pyrid-4-yl)-2H-tetrazolium
(28) 2,3-Diphenyl-5-(quinol-2-yl)-2H-tetrazolium
(29) 2,3-Diphenyl-5-(benzoxazol-2-yl)-2H-tetrazolium
(30) 2,3-Diphenyl-5-nitro-2H-tetrazolium
(31) 2,2',3,3'-Tetraphenyl-5,5'-1,4-butylene-di(2H-tetrazolium)
(32) 2,2',3,3'-Tetraphenyl-5,5'-p-phenylene-di(2H-tetrazolium)

Diffusible tetrazolium compounds can be used in the present invention by reacting them with an appropriate anionic moiety to make them nondiffusible. Examples of such moieties are higher alkylbenzene sulfonic acid anions (such as p-dodecylbenzenesulfonic acid anion); higher alkylsulfuric acid ester anions (such as laurylsulfate anion); dialkylsulfosuccinate anions (such as di-2-ethylhexylsulfosuccinate anion); polyether alcohol sulfuric acid ester anions (such as cetylpyriethenooxysulfate anion); higher fatty acid anions (such as stearic acid anion); and acid radical polymers (such as polyacrylic acid anion).

For dispersing the nondiffusible tetrazolium compound in the gelatin matrix of the present invention, both the anion moiety and the cation moiety may be a soluble salt, each of which is separately dispersed in the aqueous gelatin solution. After mixing the dispersions, the moieties are dispersed in the gelatin matrix. In other case, the tetrazolium compound previously prepared is dissolved in a proper solvent (e.g., dimethyl sulfoxide) and the solution is dispersed in a gelatin matrix. For uniformly dispersing the compound, the mixture may be emulsion dispersed by ultrasonic wave or a proper homogenizer.

In the case of using the silver halide emulsion for use in the present invention, diffusible or nondiffusible tetrazolium compound may be used. However, nondiffusible tetrazolium compound yields a high contrast image. Thus, to obtain high quality dot image, the use of a nondiffusible tetrazolium compound is preferred.

In the present invention, tetrazolium compounds may be use singly or in combinations.

It is preferred to use about $1\times10^{-3}$ to about $5\times10^{-2}$ mol of tetrazolium compound per mol of silver halide.

There are no particular restrictions on the silver halide used in the silver halide photographic emulsion layer of the present invention when a hydrazine or tetrazolium development system is used. Various halide compositions such as silver chloride, silver chlorobromide, and silver iodobromide can be used, but silver chloride or silver chlorobromide (having a bromine content of 5 mol% or lower) is preferred.

The silver halide emulsion may be chemically sensitized, but preferably it is not chemically sensitized.

Applicable types of chemical sensitization are sulfur sensitization, reduction sensitization, and noble metal sensitization. These may be used alone or in combination. Among these, sulfur sensitization is preferred; examples of a sulfur sensitizer are a sulfur compound contained in gelatin and sulfur compounds such as thiosulfates, thioureas, rhodanines.

Noble metal sensitization typically involves a gold metal sensitization using a gold complex salt. In place of the gold compound, a complex salt of another noble metal such as platinum, palladium, or rhodium may be used.

Examples of reduction sensitizers for a reduction sensitization are stannous salts, amines, formamidinesulfinic acid and silane compounds.

The mean grain size of the silver halide grains of the present invention is preferably not larger than about 0.7 μm; most preferably from about 0.5 μm to about 0.1 μm. The grain size is determined using the diameter of the grain when the grain is a sphere or a sphere-like shape, or the side length $\times\sqrt{4/\pi}$ when the grain is cubic. The mean grain size is the algebraic average or geometrical average based on the projected area of the grains. Details of the method of obtaining the mean grain size of silver halide grains are described in C. E. K. Mees and T. H. James, *The Theory of the Photographic Process,* 3rd Ed., pages 36 to 43 (1966).

There is no particular restriction on the form of the silver halide grains for use in the present invention, and the silver halide grains may be, for example, tabular, spherical, cubic, tetradecahedral, regular octahedral. It is preferred that the grain size distribution be narrow. In particular, a monodisperse silver halide emulsion, in which 90%, preferably 95%, of the total grains are within ±40% of the mean grain size, is preferred.

Systems for reacting the soluble silver salt and soluble halide of the present invention are the single jet method, the double jet method, and a combinations of these methods. The inverse mixing method permits the formation of silver halide grains in the presence of excessive silver ion. The controlled double jet method permits keeping constant pAg in the liquid phase of the silver halide grains and permits the formation of grains having regular crystal form and almost uniform grain size.

Details of useful silver halide emulsions and preparation methods are described in *Research Disclosure,* Item 17643, pages 22 and 23 (December, 1978) and the literature cited therein.

The polyalkylene oxide compounds for use in processing the photographic material of the present invention in the lith development system or the FSL development system include the condensation product of a polyalkylene oxide having from 2 to 4 carbon atoms (such as ethylene oxide, propylene-1,2-oxide, and butylene-1,2-oxides, preferably ethylene oxide) and a compound having at least one active hydrogen atom (such as water, an aliphatic alcohol, an aromatic alcohol, a fatty acid, an organic amine, and a hexytol derivative); and a block copolymer of two or more kinds of polyalkylene oxides.

The following are specific examples of such polyalkylene oxide compounds:

Polyalkylene glycols
Polyalkylene glycol alkyl ethers
Polyalkylene glycol aryl ethers
Polyalkylene glycol alkyl esters
Polyalkylene glycol alkylaryl esters
Polyalkylene glycol esters
Polyalkylene glycol fatty acid amides
Polyalkylene glycol amines
Polyalkylene glycol block copolymers
Polyalkylene glycol graft polymers The polyalkylene oxide compounds for use in the present invention may also contain one or more polyalkylene oxide chains. Each such polyalkylene oxide chain is composed of less than 10 alkylene oxide units but the sum of the alkylene oxide units in the molecule must be at least 10. When the polyalkylene oxide compound contains two or more polyalkylene oxide chains in the molecule, each may be a different alkylene oxide unit, for example, the compound may be composed of ethylene oxide and propylene oxide. The polyalkylene oxide compound for use in the present invention preferably contains from 14 to 100 polyalkylene oxide units.

Specific examples of such polyalkylene oxide compound for use in the present invention are shown below.

1. $HO(CH_2CH_2O)_9H$
2. $C_{12}H_{25}O(CH_2CH_2O)_{15}H$

3. 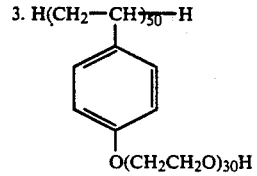

4. $C_8H_{17}CH{=}CHC_8H_{16}O(CH_2CH_2O)_{15}H$

5. 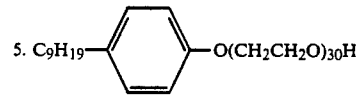

6. $C_{11}H_{23}COO(CH_2CH_2O)_{80}H$
7. $C_{11}H_{23}CONH(CH_2CH_2O)_{15}H$

8. 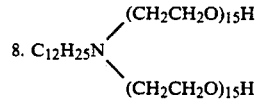

9. $C_{14}H_{29}N(CH_2)(CH_2CH_2O)_{24}H$

10. $H(CH_2CH_2O)_a(CH(CH_3)CH_2O)_b(CH_2CH_2O)_cH$ $a + b + c = 50$
$b/(a + c) = 10/9$

The amount of polyalkylene oxide compound used in the present invention is preferably from about $1\times10^{-4}$ to about $1\times10^{2}$ g/mol-Ag; preferably from about $1\times10^{-3}$ to about 10 g/mol-Ag.

A lithographic silver halide emulsion may be used in the present invention and processed using the lith development system and the FSL development system. The silver halide composition used in these systems is a silver chlorobromide or a silver chloroiodobromide (at least 60 mol%, preferably at least 75 mol% silver chloride and preferably from 0 to 5 mol% silver iodide). Silver chloride or silver chlorobromide (preferably containing not more than 5 mol% bromine) is most preferred.

There are no particular restrictions on the form, crystal habit, grain size distribution, etc., of the silver halide grains for such emulsions. However, the grain sizes are preferably not larger than 0.7 μm.

The silver halide grains may be, for example, tabular, spherical, cubic, tetradecahedral, or regular octahedral. The grain size distribution is preferably narrow. In particular, a monodisperse silver halide emulsion where 90%, preferably 95%, of the total grains are within ±40% of the mean grain size is preferred.

The silver halide emulsion may or may not be chemically sensitized as described below. Preferably it is not chemically sensitized.

The sensitivity of the silver halide emulsion can be increased without increasing the grain sizes by using a gold compound such as aurochlorate or gold trichloride; salts of other noble metal such as iridium; a sulfur compound capable of forming a silver sulfide by reacting with a silver salt; or a reducing material such as a stannous salt or an amine.

A salt of a noble metal such as iridium or an iron compound such as potassium ferricyanide may exist at the physical ripening or nucleation of the silver halide grains.

The photographic light-sensitive materials for use in the present invention can contain various compounds for preventing the formation of fog during the production, storage, or photographic processing of the light-sensitive materials or for stabilizing the photographic performance of the materials. For example, antifoggants and stabilizers such as azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phen-yl-5-mercaptotetrazole); mercaptopyrimidines; mercaptotriazines; thioketo compounds (e.g., oxazolinethione); azaindenes (e.g., triazaindenes, tetraazaindenes (in particular, 4-hydroxy-substituted(1,3-,3a,7)tetraazaindenes), pentaazaindenes; benzenethiosulfonic acid; benzenesulfinic acid; and benzenesulfonic acid amide may be used.

Both the at least one silver halide photographic emulsion and the at least one hydrophilic colloid layer of the present invention may also contain an inorganic or organic hardening agent. Examples of hardening agents are chromium salts (e.g., chromium alum and chromium acetate); aldehydes (e.g., formaldehyde, glyoxal, and glutaraldehyde); N-methylol compounds (e.g., dimethylolurea and methyl-oldimethylhydantoin); dioxane derivatives (e.g., 2,3-dihydroxydioxane); active vinyl compounds (1,3,5-triacryloyl-hexahydro-s-triazine, bis-(vinylsulfonyl)methyl ether, and N,N'-methylenebis[β-(vinylsulfonyl)propionamido]); active halogen compounds (e.g., 2,4-dichloro-6-hydroxy-s-triazine); mucohalogenic acids (e.g., mucochloric acid and mucophenoxychloric acid); isooxazoles; dialdehyde starch; and 2-chloro-6-hydroxytriazinilated gelatin. Such hardener can be used singly or together.

The at least one light-sensitive emulsion layer and/or the at least one light-insensitive hydrophilic colloid layer of the present invention may further contain various known surface active agents as a coating aid, for static prevention, for improving slipping, for improving emulsification, for preventing sticking, or generally for improving photographic characteristics.

For a protective colloid for the photographic silver halide emulsion(s) and/or other layers, gelatin is advantageously used but other hydrophilic colloids can be used. Examples of hydrophilic colloid are proteins (such as gelatin derivatives); graft polymers of gelatin and other polymers (such as albumin and casein); cellulose derivatives (such as hydroxyethyl cellulose, carboxymethyl cellulose, and cellulose sulfuric acid ester); sugar derivatives (such as sodium alginate, starch derivatives); and synthetic hydrophilic polymers (such as polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole).

Limed gelatin, acid-treated gelatin, gelatin hydrolyzed products, and gelatin enzyme-decomposed products can be used.

The photographic silver halide emulsions of the present invention can also contain a water-insoluble or sparingly water-soluble synthetic polymer to improve dimensional stability, for example. Examples of such polymers are polymers or copolymers of alkyl (meth)-acrylate; alkoxyalkyl (meth)acrylate; glycidyl (meth)-acrylate; (meth)acrylamide; vinyl esters (e.g., vinyl acetate); acrylonitrile; olefin; and styrene. The above monomers may also be combined with acrylic acid; methacrylic acid; α,β-unsaturated dicarboxylic acid; hydroxyalkyl (meth)acrylate; sulfoalkyl (meth)acrylate; or styrenesulfonic acid.

Generally, silver halide emulsion of the present invention may be spectrally sensitized with a short wave sensitizing dye. Preferably, it is not spectrally sensitized.

For the silver halide photographic materials of the present invention, various additives such as sensitizers, plasticizers, lubricants, development accelerators, oils, dyes may be added. Examples of these additives are described in *Research Disclosure,* Vol. 176, (RD-17643), pages 22 to 31 (December, 1978).

In the light-sensitive material of the present invention, the silver halide emulsion layer and/or the protective hydrophilic colloid layer may be single layers or multilayers composed of two or more layers. In the case of multilayers, interlayer(s) may be formed. The at least one photographic silver halide emulsion layer and the at least one other layer are formed on one surface or both surfaces of a flexible support of the type usually used for photographic light-sensitive materials.

Examples of such a flexible support are films of synthetic polymers such as cellulose acetate, cellulose acetate butyrate, polystyrene, polyethylene terephthalate The materials of the present invention may be processed using solutions having known compositions. For example, the developer may be a PQ developer, an MQ developer, or a lith developer. That is, the developer should be selected according to the kind of the light-sensitive material being processed and the kind and sensitivity of the high contrast system being used.

Details of the development process that may be used are described in *Research Disclosure,* Vol. 176, Item 17643, XIX, XX, and XXI, pages 28 to 30 (December, 1978).

In order to obtain superhigh contrast in a hydrazine or tetrazolium contrast development system (a $\tau$ value of at least 10), a stable developer can be used without need of using a conventional unstable lith developer (infectious developer). That is, for developing the aforesaid silver halide photographic material, such stable developers, however, must contain at least 0.15 mol/-liter of sulfite ion, have a pH of at least 9.5, and more preferably from 10.5 to 12.3 in the case of using a hydrazine derivative and is preferably from 9 to 12, and more preferably from 10 to 11 in the case of using the tetrazolium compound.

There is no particular restriction on the developing agent used in the present invention, but to obtain good dot quality dihydroxybenzenes are preferred. A combination of a dihydroxybenzene and a 1-phenyl-3-pyrazolidone, or a combination of a dihydroxybenzene and a p-aminophenol can also be used.

Specific dihydroxybenzene developing agents for use in the present invention are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone; hydroquinone is most preferred.

As 1-phenyl-3-pyrazolidone and its derivatives that can be used as a developing agent in the present invention are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl- 4,4-dimethyl-3-pyrazolidone, and 1-p-tolyl-4,4-dimethyl-3-pyrazolidone.

The p-aminophenol series developing agents of use in the present invention are N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol; among these N-methyl-p-aminophenol is preferred.

It is preferred that the developing agent be used in an amount of from 0.05 mol/liter to 0.8 mol/liter. Also, in the case of using a combination of a dihydroxybenzene and a 1-phenyl-3-pyrazolidones or a combination of a dihydroxybenzene and a p-aminophenols, it is preferred that the former is used in an amount of from 0.05 to 0.5 mol/liter and the latter is used in an amount of not more than 0.06 mol/liter.

Sulfite preservatives of use in the present invention are sodium sulfite, potassium sulfite, lithium sulfite, ammonium sulfite, sodium hydrogensulfite, potassium metahydrogensulfite, and sodium formaldehyde hydrogensulfite. The amount of sulfite is preferably at least 0.4 g/liter; most preferably at least 0.5 mol/liter. The upper limit of sulfite is preferably 2.5 mols/liter.

In the present invention, an alkali agent is used for adjusting the pH of the processing solutions. In addition, pH controlling agents and buffers, such as sodium hydroxide, potassium hydroxide, sodium carbonate, potassium carbonate, sodium tertiary phosphate, and potassium tertiary phosphate may be used.

Other additional additives for the developer for use in the present invention are boron compounds (such as boric acid and borax); development inhibitors (such as sodium bromide, potassium bromide, and potassium iodide); organic solvents (such as ethylene glycol, diethylene glycol, triethylene glycol, and dimethylformamide); and antifoggants or black pepper inhibitors (such as mercapto series compounds (e.g., 1-phenyl-5-mercaptotetrazole and sodium 2-mercaptobenzimidazole-5-sulfonate), indazole series compounds (e.g., 5-nitroindazole) and benzotriazole series compounds (e.g., 5-methylbenzotriazole)).

If necessary, the developer may contain a toning agent, a surface active agent, a defoaming agent, a water softener, a hardening agent, and the amino compounds described in JP-A-56-106244.

The developer in each development system can further contain the compounds described in JP-A-56-24347 as a silver stain inhibitor; the compounds described in JP-A-61-267759 as a dissolution aid; and the compounds described in JP-A-60-93433 as a pH buffer.

It is preferred that the developing temperature be from 18° C. to 50° C. and the developing time be from 15 seconds to 60 seconds.

A lith developer used in a lithographic development system is preferably composed of an ortho- or para-dihydroxybenzene as a developing agent, an alkali agent, a small amount of a free sulfite, and a sulfite ion buffer.

The ortho- or para-dihydroxybenzene as a developing agent is properly selected from those well known in the field of art. Specific examples of these are hydroquinone, chlorohydroquinone, bromohydroquinone, isopropylhydroquinone, toluhydroquinone, methylhydroquinone, 2,3-dichlorohydroquinone, and 2,5-dimethylhydroquinone. Of these hydroquinones, hydroquinone is preferred. These developing agents may be used singly or as a mixture. The amount of the developing agent is from $9\times10^{-3}$ to $9\times10^{-1}$ mol, and preferably from $4.5\times10^{-2}$ to $7.3\times10^{-1}$ mol per liter of the developer.

A sulfite ion buffer is used in an amount effective to keep the sulfite ion concentration in the developer at an almost constant value. Examples of such buffers are aldehyde-alkali hydrogensulfite addition products (such as a formalin-sodium hydrogensulfite addition product); ketone-alkali hydrogensulfite addition products (such as an acetone-sodium hydrogensulfite addition product); and carbonyl bisulfite-amine condensation products (such as sodium-bis(2-hydroxyethyl)aminomethane sulfonate).

The amount of the sulfite ion buffer is from 13 to 130 g per liter of developer.

An alkali sulfite, such as sodium sulfite, can be added to the developer to control the free sulfite ion concentration. The amount of the sulfite is generally not more than 5 g, and preferably not more than 3 g per liter of the developer, but under certain circumstances there may be 5 g or more.

In many cases, it is preferred that the developer contains an alkali halide (in particular, bromides such as sodium bromide and potassium bromide) as a development controlling agent. The amount of alkali halide is from about 0.01 to 10 g, preferably from about 0.1 to 5 g per liter of the developer.

For adjusting the pH of the developer above 9 (in particular from 9.7 to 11.5), an alkali agent is added to the developer. For ordinary developer, sodium carbonate or potassium carbonate is used as the alkali agent, and the amount added is selected from a wide range.

The developer for use in the present invention can also contain, if necessary, a pH buffer such as a water-soluble acid (e.g., acetic acid and boric acid); an alkali (e.g., sodium hydroxide); or a salt (e.g., sodium carbonate) as additional components. Certain kinds of an alkali functions not only to render the developer alkaline but also as a pH buffer and a development controlling agent.

The developer may also contain a preservative (such as diethanolamine, ascorbic acid, and kojic acid); an antifoggant (such as benzotriazole and 1-phenyl-5-mercaptotetrazole); and an organic solvent (such as triethylene glycol, dimethylformamide, and methanol).

This developer may contain these components at use and thus can be stored in two or more parts. For example, the developer composition can be separated into a part containing the developing agent and a part containing the alkali to be mixed and diluted at use.

Both a powder type developer and a liquid type developer can show good photographic performance.

In this development system, the developing temperature is preferably from 20° C to 40° C but other temperature may be employed, if necessary.

Developing time depends upon the developing temperature but is usually from 10 seconds to 250 seconds; most preferably from 10 seconds to 150 seconds.

Lithographic silver halide photographic materials may also be processed using a hydroquinone developer and a high concentration of a sulfite ion (practically at least 0.2 mol/liter), a high pH, and a nitroindazole series compound.

As the dihydroxybenzene developing agent, those described above for the lith developer can be used. In particular, hydroquinone is useful.

Also, the developer can contain, if necessary, the sulfite ion buffer discussed above to maintain a constant concentration of sulfite ion. Practical examples of the sulfite and the sulfite ion buffer are those described above in regard to the lith developer.

The pH of the developer is preferably 10.5 or higher.

Furthermore, the nitroindazole series compound and the developer in the system are described in detail in JP-A-58-190943.

The present invention is further described practically based on the following nonlimiting example. Unless otherwise indicated, all ratios and percentages are by weight.

| EXAMPLE | |
|---|---|
| Liquid I: | |
| Water | 600 ml |
| Gelatin | 18 g |
| pH | 3.0 |
| Liquid II: | |
| $AgNO_3$ | 200 g |
| Water | 800 ml |
| Liquid III: | |
| KBr | 1.4 g |
| NaCl | 76 g |
| $(NH_4)_3RhCl_6$ | 4 mg |
| Water | 800 ml |

(1) A general emulsion was prepared as follows:

To Liquid I kept at 40° C. were added Liquids II and III using a both-side double jet method at a constant rate over a period of 20 minutes. After removing the soluble salts from the emulsion, gelatin was added, and without ripening 2-methyl-4-hydroxy-1,3,3a,7-tetraazaindene was added to the emulsion as a stabilizer.

The mean grain size of the silver halide emulsion thus prepared was 0.20 μm, the amount thereof was 1 kg, the content of Br was 1 mol%, the content of Rh was $1.0\times10^{-5}$ mol per mol Ag, and the content of gelatin was 60 g.

Emulsion A was prepared by adding polyalkylene oxide (PED) shown below to the general emulsion.

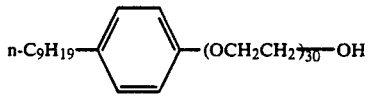

Emulsion B was prepared by adding the following hydrazine compound (Hz) to the general emulsion.

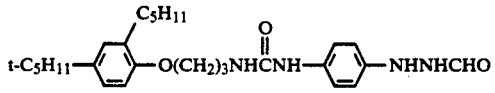

Emulsion C was prepared by adding the following tetrazolium salt (T-salt) to the general emulsion.

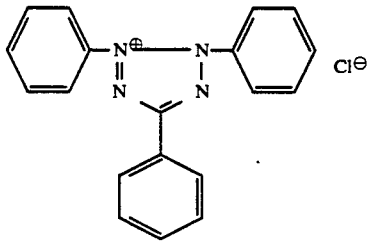

After adding each of the compounds of formula (I) and the ultraviolet absorbent (Compound (2)) to each of Emulsions A, B, and C as shown in Table 1 below, a polyethyl acrylate latex was added thereto in an amount of 30% by weight (as solid component) based on the amount of gelatin. After adding 1,3-vinylsulfonyl-2-propanol as a hardening agent, each emulsion was coated on a polyethylene terephthalate film at a silver coverage of 4.0 g/m². A protective layer containing the yellow dye shown below for improving the safety of a safelight such that the coated coverage became 120 mg/m² of the yellow dye and 1.5 g/m² of gelatin was formed on the emulsion layer to provide each sample.

Yellow Dye:

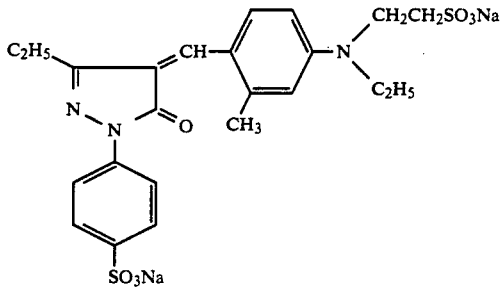

Thus, Samples A-1 to A-8, Samples B-1 to B-8, and Samples C-1 to C-4 were prepared.

Each sample was exposed on a light-room printer P-607 (trade name, made by Dainippon Screen Mfg. Co., Ltd.) through an optical wedge, subjected to the standard processing for each system, and the value measured by the method described above. The results obtained are shown in Table 1 below.

TABLE 1

| Sample No. | Emulsion | High Contrast Imparting Compound: Compound | High Contrast Imparting Compound: Amount (mol/mol Ag) | Ultraviolet Absorbent (2) Amount ($mg/m^2$) | Compound of Formula (I): Compound No. | Compound of Formula (I): Amount (mol/mol Ag) | Developer | Gradation (γ) |
|---|---|---|---|---|---|---|---|---|
| A-1 | A | PEO | $1 \times 10^{-4}$ | — | — | — | FS-2 | 15.6 |
| A-2 | " | " | " | — | I-17 | $1 \times 10^{-4}$ | " | 15.8 |
| A-3 | " | " | " | — | " | $5 \times 10^{-4}$ | " | 16.0 |
| A-4 | " | " | " | 100 | — | — | " | 14.6 |
| A-5 | " | " | " | " | I-51 | $1 \times 10^{-4}$ | " | 15.0 |
| A-6 | " | " | " | " | " | $5 \times 10^{-4}$ | " | 15.5 |
| A-7 | " | " | $1 \times 10^{-5}$ | " | — | — | " | 8.0 |
| A-8 | " | " | " | " | I-51 | $5 \times 10^{-4}$ | " | 9.0 |
| B-1 | B | HZ | $4 \times 10^{-4}$ | — | — | — | Developer A | 15.2 |
| B-2 | " | " | " | — | — | $1 \times 10^{-4}$ | " | 14.3 |
| B-3 | " | " | " | 100 | I-17 | " | " | 14.1 |
| B-4 | " | " | " | " | I-41 | " | " | 13.8 |
| B-5 | " | " | " | " | I-51 | " | " | 14.0 |
| B-6 | " | " | " | " | I-55 | " | " | 13.0 |
| B-7 | " | " | $4 \times 10^{-5}$ | " | — | — | " | 8.5 |
| B-8 | " | " | " | " | I-51 | " | " | 8.0 |
| C-1 | C | T-Salt | $5 \times 10^{-3}$ | — | — | — | Developer B | 20 |
| C-2 | " | " | " | — | I-51 | $5 \times 10^{-4}$ | " | 17 |
| C-3 | " | " | " | 100 | " | " | " | 15 |
| C-4 | " | " | $5 \times 10^{-4}$ | " | " | " | " | 8.6 |

Regarding Samples A-1 to A-8, an FSL system Developer FS-2 (trade name, made by Fuji Photo Film Co., Ltd.) was used for the processing, for Samples B-1 to B-8, Developer A was used, and for Samples C-1 to C-4, Developer B was used.

(2) After imagewise exposing each of Samples A-1 to A-8 under the exposure conditions shown in Table 3 below in the original construction as shown in FIG. 1, each sample was processed for 20 seconds at 38° C. using automatic processor FG-660F (made by Fuji Photo Film Co., Ltd.) using the FSL system Developer FS-2 (made by Fuji Photo Film Co., Ltd.). The quality of the white letters on the solid background was evaluated.

The light source filter, SC-38 or SC-41 (made by Fuji Photo Film Co., Ltd.) was as shown in FIG. 2. The spectral transmittance of these filters is also shown in FIG. 2.

An image quality of 5 of the white letters on a solid background means the image of the reproduced letter has a width of 30 μm when an adequate light exposure was applied using the originals constructed as shown in FIG. 1 such that the dot area of 50% was reproduced on the light-sensitive material. An image quality of 5 means the best quality.

For contrast, an image quality of 1 of the white letters on a solid background means that only the letters of at least 150 μm can be reproduced when the similar adequate exposure is applied. An image quality of 1 being the worst quality rank. Between the rank of 5 and the rank of 1, ranks 2 to 4 are provided by functional evaluation. A rank of 3 or higher means the image is usable.

For these samples, the time in seconds required for exposure was controlled the exposure amount using filters (ND filters) as set out below so that the exposure time (seconds) was the same for each sample.

TABLE 2

| Test No. | Sample No. | Exposure: Exposure Light Source | Exposure: Filter | Image Quality of White Letters on a Solid Background |
|---|---|---|---|---|
| 1 | A-1 | A | No use | 2 |
| 2 | A-2 | " | " | 2.5 |
| 3 | A-3 | " | " | 3 |
| 4 | A-4 | " | " | 2.5 |

TABLE 2-continued

| Test No. | Sample No. | Exposure: Exposure Light Source | Exposure: Filter | Image Quality of White Letters on a Solid Background | |
|---|---|---|---|---|---|
| 5 | A-5 | " | " | 5 | Invention |
| 6 | A-6 | " | " | 5 | " |
| 7 | A-7 | " | " | 1.5 | |
| 8 | A-8 | " | " | 2 | |
| 9 | A-1 | " | SC-38 | 3.0 | |
| 10 | " | " | SC-41 | 3.5 | |
| 11 | A-2 | " | SC-38 | 5 | Invention |
| 12 | " | " | SC-41 | 5 | " |
| 13 | A-3 | " | SC-38 | 5 | " |
| 14 | " | " | SC-41 | 5 | " |
| 15 | A-2 | B | No use | 5 | " |
| 16 | A-3 | " | " | 5 | " |

TABLE 3

| Test No. | Sample No. | Exposure: Exposure Light Source | Exposure: Filter | Image Quality of White Letters on a Solid Background | |
|---|---|---|---|---|---|
| 17 | B-1 | A | No use | 1.5 | |
| 18 | B-2 | " | " | 2.5 | |
| 19 | B-3 | " | " | 2.5 | |
| 20 | B-4 | " | " | 2.5 | |
| 21 | B-5 | " | " | 5 | Invention |
| 22 | B-6 | " | " | 5 | " |
| 23 | B-7 | " | " | 1 | |
| 24 | B-8 | " | " | 1.5 | |
| 25 | B-1 | " | SC-39 | 3.5 | |
| 26 | " | " | SC-41 | 3.5 | |
| 27 | B-2 | " | SC-39 | 5 | |
| 28 | " | " | SC-41 | 5 | Invention |
| 29 | B-1 | B | No use | 3.5 | |
| 30 | B-2 | " | " | 5 | Invention |
| 31 | C-1 | A | " | 1.5 | |
| 32 | C-2 | " | " | 2.5 | |
| 33 | C-3 | " | " | 5 | Invention |
| 34 | C-4 | " | " | 1.5 | |
| 35 | C-1 | " | SC-41 | 3.0 | |
| 36 | C-2 | " | " | 5.0 | Invention |

Exposure Light Source A:
P-607 (superhigh mercury lamp ORC-CHM-1000), made by Dainippon Screen Mfg. Co., Ltd.
Exposure Light Source B:
Eye Dolphin (metal halide lamp 3 kw MQ-300), made by Eye Graphix Co., Ltd.

The emission energy distributions of the light sources are shown in FIG. 2.

From the results shown in Table 2, Test Nos. 5, 6, and 11 to 16, which are embodiments of the present invention, show excellent reproduction of white letters on a solid background.

(3) As safelight safety tests, each of Samples B-1 to B-8 and C-1 to C-4 was exposed and developed under the conditions shown in Table 3 by the same way as described in section (2) above, and the image quality of the reproduced letters evaluated.

Samples B-1 to B-8 were processed for 20 seconds at 38° C using an automatic processor FG-660F (made by Fuji Photo Film Co., Ltd.) with Developer A. Samples C-1 to C-4 were processed for 20 seconds at 38° C. using the automatic processor GR-27 (made by Konica Corporation) using Developer B. Developers A and B are described below.

As is clear from Table 3 above, Test Nos. 21, 22, 28, 30, 33, and 36, which are embodiment of the present invention, showed excellent reproduction of white letters on a solid background.

| | | |
|---|---|---|
| Developer A: | | |
| Hydroquinone | 45.0 | g |
| N-Methyl-p-aminophenol ½ Sulfate | 0.8 | g |
| Sodium Hydroxide | 18.0 | g |
| Potassium Hydroxide | 55.0 | g |
| 5-Sulfosalicylic Acid | 45.0 | g |
| Boric Acid | 25.0 | g |
| Potassium Sulfite | 110.0 | g |
| Ethylenediaminetetraacetic Acid Disodium Salt | 1.0 | g |
| Potassium Bromide | 6.0 | g |
| 5-Methylbenzotriazole | 0.6 | g |
| n-Butyl-diethanolamine | 15.0 | g |
| Water to make | 1 | liter |
| pH | 11.6 | |
| Developer B: | | |
| Ethylenediaminetetraacetic Acid Disodium Salt (dihydrate) | 0.75 | g |
| Anhydrous Potassium Sulfite | 51.7 | g |
| Anhydrous Potassium Carbonate | 60.4 | g |
| Hydroquinone | 15.1 | g |
| 1-Phenyl-3-pyrazolidone | 0.51 | g |
| Sodium Bromide | 2.2 | g |
| 5-Methylbenzotriazole | 0.124 | g |
| 1-Phenyl-5-mercaptotetrazole | 0.018 | g |
| 5-Nitroindazole | 0.106 | g |
| Diethylene Glycol | 98 | g |
| Water to make | 1 | liter |
| pH | 10.5 | |

While the invention has been described in detail and with reference to specific embodiments thereof, it will be apparent to one skilled in the art that various changes and modifications can be made therein without departing from the spirit and scope thereof.

What is claimed is:

1. A method of forming an image comprising the steps of (a) imagewise exposing a silver halide photographic material to light having substantially no wavelengths of less than 370 nm, said silver halide photographic material comprising: (i) a support, (ii) at least one light-sensitive silver halide emulsion layer formed on said support, (iii) at least one other hydrophilic colloid layer, and (iv) a redox compound that releases a development inhibitor when oxidized in at least one of said at least one light-sensitive layer or said at least one other hydrophilic colloid layer; and (b) processing said exposed silver halide material from step (a) to produce a value of at least 10.0; wherein said redox compound is a compound represented by formula (I);

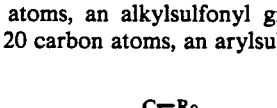

$$R-\underset{\underset{A_1}{|}}{N}-\underset{\underset{A_2}{|}}{N}-V\leftarrow Time\rightarrow_t PUG \quad (I)$$

wherein $A_1$ and $A_2$ both represent a hydrogen atom or one of them represents a hydrogen atom and the other represents an alkylsulfonyl group having not more than 20 carbon atoms, an alkylsulfonyl group having not more than 20 carbon atoms, an arylsulfonyl group or

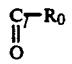

$$\underset{\underset{O}{\|}}{C}-R_0$$

wherein $R_0$ represents an alkyl group, an alkenyl, an aryl group, an alkoxy group, or an aryloxy group; and l represents 1 or 2); Time represents a divalent linkage group; t represents 0 or 1; PUG represents a development inhibitor; V represents a carbonyl group,

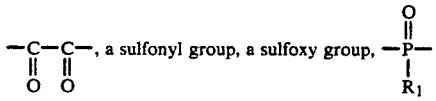

$$-\underset{\underset{O}{\|}}{C}-\underset{\underset{O}{\|}}{C}-, \text{ a sulfonyl group, a sulfoxy group, } -\overset{\overset{O}{\|}}{\underset{\underset{R_1}{|}}{P}}-$$

a sulfonyl group, a sulfoxy group, (wherein $R_1$ represents an alkoxy group or an aryloxy group), an iminomethylene group, or a thiocarbonyl group; and R represents an aliphatic group, an aromatic group, or a heterocyclic group.

2. The method of forming an image as claimed in claim 1, wherein said at least one light-sensitive silver halide emulsion layer contains an inorganic desensitizer, an organic desensitizer, or a safelight dye.

3. The method of forming an image as claimed in claim 2, wherein said inorganic desensitizer is a rhodium salt, an iridium salt, or a cupric chloride.

4. The method of forming an image as claimed in claim 1, wherein the amount of said redox compound is from about $1.0\times10^{-6}$ mol to about $5.0\times10^{-2}$ mol per mol of silver halide.

5. The method of forming an image as claimed in claim 1, wherein said light-sensitive silver halide emulsion layer or hydrophilic colloid layer contains a hydrazine derivative.

6. The method of forming an image as claimed in claim 5, wherein said hydrazine derivative is a compound represented by formula (II):

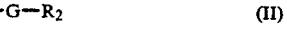

$$R_1-NHNH-G-R_2 \quad (II)$$

wherein $R_1$ represents an aliphatic group or an aromatic group; $R_2$ represents a hydrogen atom, a substituted or unsubstituted alkyl group, a substituted or unsubstituted aryl group, a substituted or unsubstituted alkoxy group, or a substituted or unsubstituted aryloxy group; and G represents a carbonyl group, a sulfoxy group, a phosphoryl group, or an N-substituted or unsubstituted iminomethylene group.

7. The method of forming an image as claimed in claim 6, wherein the amount of said hydrazine derivative is from about $1\times10^{-6}$ mol to about $1\times10^{-1}$ mol per mol of silver halide.

8. The method of forming an image as claimed in claim 1, wherein said light-sensitive silver halide emulsion layer or hydrophilic colloid layer contains a tetrazolium compound.

9. The method of forming an image as claimed in claim 8, wherein the amount of said tetrazolium compound is from about $1\times10^{-3}$ mol to about $5\times10^{-2}$ mol per mol of silver halide.

10. The method of forming an image as claimed in claim 1, wherein said silver halide photographic material contains an ultraviolet absorbent.

11. The method of forming an image as claimed in claim 10, wherein the amount of said ultraviolet absorbent is from about $10^{-2}$ g/m$^2$ to about 1 g/m$^2$.

12. The method of forming an image as claimed in claim 1, wherein an optical filter for absorbing ultraviolet rays is used as a light source filter.

* * * * *